US011396408B2

(12) United States Patent
Jinkins et al.

(10) Patent No.: US 11,396,408 B2
(45) Date of Patent: Jul. 26, 2022

(54) LID FOR CONTAINER

(71) Applicant: YETI Coolers, LLC, Austin, TX (US)

(72) Inventors: Cody Jinkins, Austin, TX (US); Liza Morris, Austin, TX (US); John Loudenslager, Austin, TX (US)

(73) Assignee: YETI Coolers, LLC, Austin, TX (US)

( * ) Notice: Subject to any disclaimer, the term of this patent is extended or adjusted under 35 U.S.C. 154(b) by 201 days.

(21) Appl. No.: 16/531,736

(22) Filed: Aug. 5, 2019

(65) Prior Publication Data

US 2021/0039846 A1 Feb. 11, 2021

(51) Int. Cl.

| | |
|---|---|
| ***B65D 47/08*** | (2006.01) |
| ***B65D 51/18*** | (2006.01) |
| ***B65D 51/24*** | (2006.01) |
| ***A47G 19/22*** | (2006.01) |

(52) U.S. Cl.

CPC ..... *B65D 47/0885* (2013.01); *B65D 47/0871* (2013.01); *B65D 51/18* (2013.01); *B65D 51/242* (2013.01); *A47G 19/2272* (2013.01); *B65D 2251/0025* (2013.01); *B65D 2251/0081* (2013.01); *B65D 2251/1058* (2013.01)

(58) Field of Classification Search

CPC ..... B65D 47/0885; B65D 47/0871; B65D 51/18; B65D 51/242; B65D 2251/1058; B65D 2251/0025; B65D 2251/0081; B65D 50/04; B65D 2251/1033; A45F 3/18

USPC ..... 215/237; 222/556

See application file for complete search history.

(56) References Cited

U.S. PATENT DOCUMENTS

| | | | |
|---|---|---|---|
| 1,002,860 | A | 7/1910 | Morley |
| 1,000,434 | A | 12/1910 | Nelson |
| 4,170,315 | A | 10/1979 | Dubach et al. |
| 4,638,916 | A | 1/1987 | Beck et al. |
| 5,547,111 | A | 8/1996 | Geiger et al. |

(Continued)

FOREIGN PATENT DOCUMENTS

| | | | |
|---|---|---|---|
| AU | 2010340047 | A1 | 6/2012 |
| AU | 2018382373 | A1 | 6/2020 |

(Continued)

OTHER PUBLICATIONS

English translation of JP2015231852A, provided by Espacenet. http://translationportal.epo.org/emtp/translate/?ACTION=description-retrieval&COUNTRY=JP&ENGINE=google&FORMAT=docdb&KIND=A&LOCALE=en_EP&NUMBER=2015231852&OPS=ops.epo.org/3.2&SRCLANG=ja&TRGLANG=en (Year: 2021).*

(Continued)

*Primary Examiner* — James N Smalley
(74) *Attorney, Agent, or Firm* — Banner & Witcoff, Ltd.

(57) ABSTRACT

A lid can include a lid body having an opening and locking projection and a flip cover may include a flip cover flange where the flip cover can be configured to cover the opening. A release mechanism can include a latching mechanism for receiving the flange of the flip cover to secure the flip cover in the closed position. A locking slider may include an arm having a distal end that can be configured to interfere with the locking projection of the lid body to prevent the release mechanism from rotating and releasing the flip cover. The locking slider can be displaced such that the distal end of the arm moves away from the locking projection of the lid body and the release mechanism is permitted to move the latching mechanism away from the flip cover flange and the flip cover can be moved into an open position.

18 Claims, 14 Drawing Sheets

(56) References Cited

U.S. PATENT DOCUMENTS 5,671,875 A 9/1997 Robbins, III et al.
5,850,953 A 12/1998 Dallas, Jr.
6,079,589 A 6/2000 Matsuyama et al.
6,269,984 B1 8/2001 Murakami
6,269,986 B1 8/2001 Gross
D455,611 S 4/2002 Kitamura et al.
6,644,487 B2 11/2003 Smith et al.
D485,132 S 1/2004 Ohno et al.
D505,294 S 5/2005 Gauss
7,044,317 B2 5/2006 Smith et al.
D529,339 S 10/2006 Carreno et al.
D533,061 S 12/2006 Li
7,163,127 B2 1/2007 Seelhofer
D538,110 S 3/2007 Kitamura et al.
D547,607 S 7/2007 Forsman
7,281,638 B2 10/2007 Hierzer et al.
D565,353 S 4/2008 Roth et al.
D586,184 S 2/2009 Miller et al.
D588,411 S 3/2009 Watanabe
D590,661 S 4/2009 Kitamura et al.
7,533,783 B2 5/2009 Choi et al.
7,556,172 B2 7/2009 Lane
D608,640 S 1/2010 Carreno
D610,454 S 2/2010 Lohrman et al.
D614,440 S 4/2010 Cresswell et al.
7,753,240 B2 7/2010 Leoncavallo et al.
D626,837 S 11/2010 Meyers et al.
D626,838 S 11/2010 Meyers et al.
7,870,980 B2 1/2011 Wilson et al.
D634,972 S 3/2011 Staton
D636,672 S 4/2011 Lohrman et al.
D638,658 S 5/2011 Staton
D640,093 S 6/2011 Picozza et al.
8,051,997 B2 11/2011 Buckley
D652,256 S 1/2012 Eyal
D655,580 S 3/2012 Kotani
D655,581 S 3/2012 Kotani
D656,360 S 3/2012 Miller et al.
D657,994 S 4/2012 Wahl et al.
D658,446 S 5/2012 George
8,245,870 B2 8/2012 McKinney et al.
D668,503 S 10/2012 Kotani
D669,733 S 10/2012 Jewett et al.
8,292,133 B2 10/2012 Baughman et al.
8,336,724 B2 12/2012 Yamashita et al.
D675,060 S 1/2013 Lane
8,403,159 B2 3/2013 Antier et al.
D679,541 S 4/2013 Samartgis
8,408,414 B2 4/2013 Roth et al.
8,413,832 B2 4/2013 Mazurkiewicz et al.
D682,016 S 5/2013 Knight
D682,034 S 5/2013 El-Saden et al.
8,434,639 B2 5/2013 Markert
D683,581 S 6/2013 Archer
8,540,121 B2 9/2013 Walters et al.
8,550,269 B2 10/2013 Lane
D696,551 S 12/2013 Meyers et al.
8,602,238 B2 12/2013 El-Saden et al.
8,622,229 B2 1/2014 Lane
8,646,633 B2 2/2014 Huntington et al.
8,678,228 B2 3/2014 Steininger
D702,505 S 4/2014 Nakatani
8,684,231 B2 4/2014 Lane et al.
8,689,989 B2 4/2014 Lane
8,695,830 B2 4/2014 Meyers et al.
8,752,720 B1 6/2014 Habig et al.
8,833,586 B2 9/2014 Meyers et al.
8,844,746 B2 9/2014 Meyers et al.
8,844,762 B2 9/2014 Chiou et al.
D716,657 S 11/2014 Caneer
D718,626 S 12/2014 Lane
D719,444 S 12/2014 Sullivan
D719,445 S 12/2014 Caneer
D719,780 S 12/2014 Sullivan
8,905,252 B2 12/2014 Latham et al.
D721,276 S 1/2015 Herbst
8,931,243 B2 1/2015 Guglielmini et al.
8,939,305 B2 1/2015 Meyers et al.
8,960,490 B2 * 2/2015 Carlile ..... B65D 47/249 220/832
D723,328 S 3/2015 Steel
D723,332 S 3/2015 Steel
8,978,923 B2 3/2015 George
8,985,370 B2 3/2015 Lane
8,985,377 B2 3/2015 Lane
D729,569 S 5/2015 Herbst et al.
9,022,239 B2 5/2015 Mackenzie et al.
9,027,769 B2 5/2015 Willows et al.
9,061,813 B2 6/2015 Steininger
9,113,698 B2 8/2015 Blain et al.
D739,174 S 9/2015 Elsaden et al.
D739,183 S 9/2015 Lane
9,120,604 B2 9/2015 Lohn
D741,113 S 10/2015 Miros et al.
D741,637 S 10/2015 Palermo et al.
9,150,335 B2 10/2015 Lane
D742,230 S 11/2015 Charles
D743,742 S 11/2015 Rummel et al.
D745,827 S 12/2015 Sorensen et al.
9,211,040 B2 12/2015 Lane
9,216,843 B2 12/2015 Sorensen et al.
D747,918 S 1/2016 Herbst et al.
D748,478 S 2/2016 Sorensen et al.
D748,943 S 2/2016 Miller et al.
D750,490 S 3/2016 Moore et al.
D752,382 S 3/2016 Ksiazek et al.
D752,390 S 3/2016 Ksiazek et al.
9,272,822 B2 3/2016 Samartgis
9,282,838 B2 3/2016 Sims
D752,916 S 4/2016 Goodwin et al.
D754,483 S 4/2016 Elsaden et al.
D755,562 S 5/2016 Lindsay
D756,701 S 5/2016 Mettler et al.
D756,702 S 5/2016 Joseph et al.
D758,127 S 6/2016 Zhao
D758,790 S 6/2016 Boroski
D760,080 S 6/2016 Gorbold
D761,058 S 7/2016 Ou
9,380,898 B2 7/2016 Mason
9,382,045 B2 7/2016 Wohlgenannt et al.
D763,688 S 8/2016 Breit et al.
D767,336 S 9/2016 Waggoner et al.
D768,491 S 10/2016 Sorensen et al.
D770,222 S 11/2016 Boroski et al.
D771,990 S 11/2016 Horowitz
9,499,315 B1 11/2016 Lue et al.
D775,950 S 1/2017 Rognard
D778,117 S 2/2017 Du
D778,118 S 2/2017 Du
D780,516 S 3/2017 Cornelius
D780,517 S 3/2017 Boroski et al.
D781,104 S 3/2017 Cerasani
9,586,733 B2 3/2017 Garza
D782,880 S 4/2017 Matsuo
D783,369 S 4/2017 Matsuo
D787,268 S 5/2017 Matsuo
D787,886 S 5/2017 Cerasani
9,636,613 B2 5/2017 Hayslett et al.
D788,583 S 6/2017 Tu
D789,140 S 6/2017 Joseph
9,675,191 B2 6/2017 Kurabe et al.
D791,532 S 7/2017 Yao
9,701,453 B2 7/2017 Moradi
D794,386 S 8/2017 Steel et al.
D794,453 S 8/2017 Boroski et al.
D795,011 S 8/2017 Pisarevsky
9,724,629 B2 8/2017 Lane
9,745,110 B2 8/2017 Boyer et al.
D797,513 S 9/2017 Matsuo
9,764,879 B2 9/2017 Koenigseder et al.
9,770,125 B2 9/2017 Joy et al.
9,771,189 B2 9/2017 Miksovsky et al.
D799,898 S 10/2017 Yao
D801,173 S 10/2017 Lown et al.

(56) References Cited

U.S. PATENT DOCUMENTS 9,776,777 B2 10/2017 Gorbold
9,790,007 B2 10/2017 Sorensen et al.
D802,993 S 11/2017 Joseph et al.
D804,903 S 12/2017 Mason et al.
D804,904 S 12/2017 Noveletsky et al.
9,850,044 B2 12/2017 Muhlemann
D807,110 S 1/2018 Lown
D807,111 S 1/2018 Sorensen et al.
D808,713 S 1/2018 Rane et al.
9,868,570 B2 1/2018 Ferrari et al.
9,877,607 B2 1/2018 Beckman et al.
D809,856 S 2/2018 Winn et al.
D810,502 S 2/2018 Joseph et al.
D811,162 S 2/2018 Rane et al.
9,901,201 B2 2/2018 Shen
9,902,533 B2 2/2018 Meyers et al.
D811,810 S 3/2018 Joseph et al.
D812,966 S 3/2018 Murosky et al.
D812,970 S 3/2018 Rane et al.
D815,889 S 4/2018 Xu
D815,901 S 4/2018 Steinmann
9,932,158 B2 4/2018 Rognard et al.
9,938,054 B2 4/2018 Choltco-Devlin
9,944,437 B2 * 4/2018 Lin ..... B65D 47/088
D816,411 S 5/2018 Stover
D817,084 S 5/2018 Hammer
D817,085 S 5/2018 Davis
D817,088 S 5/2018 Shirley
D817,713 S 5/2018 Lin
D818,309 S 5/2018 Jasso Gomez
D818,317 S 5/2018 Fu
D818,767 S 5/2018 Nezu
D818,768 S 5/2018 Joseph et al.
D818,774 S 5/2018 Stover
D820,038 S 6/2018 Sorensen et al.
D820,635 S 6/2018 Hammer
D820,637 S 6/2018 Davis
D821,135 S 6/2018 Rane et al.
10,004,348 B2 6/2018 Sorensen et al.
D821,809 S 7/2018 Rane et al.
D821,815 S 7/2018 Chung
D821,816 S 7/2018 Racamier
D823,061 S 7/2018 Murosky et al.
D824,721 S 8/2018 Hu
10,059,491 B2 8/2018 Wong
D828,722 S 9/2018 Davis
D830,119 S 10/2018 Sorensen et al.
D838,549 S 1/2019 Gu
D843,174 S 3/2019 Zhang
D843,175 S 3/2019 Zhang
D844,384 S 4/2019 Potter et al.
D848,786 S 5/2019 Bujalska
D848,787 S 5/2019 Tatsukawa et al.
D849,481 S 5/2019 Washburn
10,293,994 B2 5/2019 Coon et al.
10,315,815 B2 6/2019 Bentkovski
10,329,061 B2 6/2019 Dias et al.
D853,195 S 7/2019 Chen
D853,784 S 7/2019 Wu
D853,791 S 7/2019 Gispert
10,336,510 B2 7/2019 El-Saden et al.
10,336,513 B2 7/2019 Wodka
10,351,313 B2 7/2019 George
D857,445 S 8/2019 Keung
10,390,643 B2 8/2019 Anderl
D858,181 S 9/2019 Lown
D858,182 S 9/2019 Keung
D860,732 S 9/2019 Fleischhut
10,399,745 B2 9/2019 Fang
10,414,555 B2 9/2019 Steinmann et al.
D862,157 S 10/2019 Barber
D862,985 S 10/2019 Backs
D863,877 S 10/2019 Meyers
10,433,665 B2 10/2019 Zhang et al.
10,442,591 B2 10/2019 Rognard et al.
10,455,959 B2 10/2019 Coon et al.
D868,533 S 12/2019 Han
D869,230 S 12/2019 Hao
D870,508 S 12/2019 Palkon
D871,132 S 12/2019 Yao
10,512,347 B1 12/2019 Shepard et al.
10,518,944 B2 12/2019 Choltco-Devlin
D871,833 S 1/2020 Farsai
10,542,833 B2 1/2020 Davies et al.
10,562,681 B2 2/2020 Koenigseder et al.
10,569,940 B2 2/2020 Davies
D879,550 S 3/2020 Lane et al.
D884,419 S 5/2020 Backs
D885,120 S 5/2020 Yao
10,660,463 B2 5/2020 Sims
D887,781 S 6/2020 Bergstrom
10,676,255 B2 6/2020 Choi et al.
10,683,146 B2 6/2020 Farsai et al.
10,687,641 B2 6/2020 Sorensen et al.
10,687,643 B2 6/2020 Cheng
2003/0136783 A1 7/2003 Hatsumoto et al.
2003/0136803 A1 7/2003 Kuwano et al.
2003/0178433 A1 9/2003 Adams
2005/0051508 A1 3/2005 Hackmann et al.
2005/0274741 A1 12/2005 Cho
2006/0175330 A1 8/2006 Richardson
2007/0102390 A1 5/2007 Hoepner et al.
2007/0114202 A1 5/2007 Lee
2007/0151993 A1 7/2007 Yelland
2007/0172305 A1 7/2007 Altonen et al.
2007/0205176 A1 9/2007 Karp
2007/0251949 A1 11/2007 Barre et al.
2009/0101646 A1 4/2009 Paul et al.
2009/0255944 A1 10/2009 Yamashita et al.
2010/0127021 A1 5/2010 Schantz et al.
2011/0220673 A1 9/2011 Huntington et al.
2012/0037651 A1 2/2012 Steuer
2012/0067922 A1 3/2012 Benoit-Gonin
2012/0080456 A1 4/2012 Steininger
2013/0056467 A1 3/2013 Shepard et al.
2013/0140309 A1 6/2013 George
2013/0175271 A1 7/2013 Lim
2013/0199134 A1 8/2013 Huntington et al.
2013/0233869 A1 9/2013 Tamarit Rios et al.
2013/0319966 A1 * 12/2013 Lane ..... A45F 3/18 215/237
2014/0001192 A1 1/2014 Steininger
2014/0001212 A1 1/2014 Steininger
2015/0060448 A1 3/2015 Coon et al.
2015/0164255 A1 6/2015 Coon et al.
2015/0201776 A1 7/2015 Elsaden et al.
2015/0232318 A1 8/2015 Meldeau
2016/0166094 A1 6/2016 Tebbe et al.
2016/0207672 A1 7/2016 Wong
2016/0244219 A1 8/2016 Benoit-Gonin et al.
2016/0255973 A1 9/2016 Joseph et al.
2016/0296050 A1 10/2016 Lane
2017/0050773 A1 2/2017 Rognard et al.
2017/0066569 A1 3/2017 Wiesman
2017/0105581 A1 4/2017 Enghard
2017/0144811 A1 5/2017 Wohlgenannt
2017/0158384 A1 6/2017 Enghard
2017/0225849 A1 8/2017 Miros et al.
2017/0225850 A1 8/2017 Sorensen et al.
2017/0240326 A1 8/2017 Rognard et al.
2017/0253389 A1 9/2017 Fogarty et al.
2017/0253395 A1 9/2017 Matthis
2017/0253397 A1 9/2017 Coon et al.
2017/0267423 A1 9/2017 Maruyama et al.
2017/0297785 A1 10/2017 Maruyama et al.
2017/0313478 A1 11/2017 El-Saden et al.
2017/0320640 A1 11/2017 Steinmann
2017/0327282 A1 11/2017 Choltco-Devlin
2018/0050848 A1 2/2018 Choltco-Devlin et al.
2018/0170628 A1 6/2018 Rognard
2018/0192800 A1 7/2018 Coon et al.
2019/0100362 A1 4/2019 Meyers et al.
2019/0133355 A1 5/2019 Davies et al.
2019/0135504 A1 5/2019 Koenigseder et al.

(56) References Cited

U.S. PATENT DOCUMENTS

| | | | |
|---|---|---|---|
| 2019/0161251 | A1 | 5/2019 | Fang |
| 2019/0177049 | A1 | 6/2019 | Farsai et al. |
| 2019/0183269 | A1 | 6/2019 | Kalisz et al. |
| 2019/0210773 | A1 | 7/2019 | Huang |
| 2019/0263572 | A1 | 8/2019 | Keung |
| 2019/0282979 | A1 | 9/2019 | Noall et al. |
| 2019/0365125 | A1 | 12/2019 | Sorensen et al. |
| 2020/0039703 | A1 | 2/2020 | Steinmann et al. |
| 2020/0039706 | A1 | 2/2020 | Gilbert et al. |
| 2020/0071027 | A1 | 3/2020 | Lane |
| 2020/0095028 | A1 | 3/2020 | Cheng |
| 2020/0148431 | A1 | 5/2020 | Tsai |
| 2020/0172304 | A1 | 6/2020 | Owusu |
| 2020/0180824 | A1 | 6/2020 | Muhlemann |

FOREIGN PATENT DOCUMENTS

| | | | |
|---|---|---|---|
| BR | 112012014572 | A2 | 3/2016 |
| CA | 2491577 | A1 | 7/2005 |
| CA | 2783361 | A1 | 7/2011 |
| CN | 2312889 | Y | 4/1999 |
| CN | 1323014 | A | 11/2001 |
| CN | 200978079 | Y | 11/2007 |
| CN | 201033665 | Y | 3/2008 |
| CN | 100542905 | C | 9/2009 |
| CN | 101624105 | A | 1/2010 |
| CN | 102018417 | A | 4/2011 |
| CN | 102556483 | A | 7/2012 |
| CN | 202375759 | U | 8/2012 |
| CN | 102666301 | A | 9/2012 |
| CN | 202408222 | U | 9/2012 |
| CN | 102730297 | A | 10/2012 |
| CN | 202717145 | U | 2/2013 |
| CN | 103224084 | A | 7/2013 |
| CN | 103224087 | A | 7/2013 |
| CN | 203088483 | U | 7/2013 |
| CN | 203407828 | U | 1/2014 |
| CN | 103815741 | A | 5/2014 |
| CN | 104000450 | A | 8/2014 |
| CN | 203802166 | U | 9/2014 |
| CN | 104129579 | A | 11/2014 |
| CN | 203969968 | U | 12/2014 |
| CN | 203975502 | U | 12/2014 |
| CN | 104276338 | A | 1/2015 |
| CN | 104276354 | A | 1/2015 |
| CN | 104276355 | A | 1/2015 |
| CN | 204071520 | U | 1/2015 |
| CN | 104417958 | A | 3/2015 |
| CN | 204292792 | U | 4/2015 |
| CN | 105147013 | A | 12/2015 |
| CN | 204822508 | U | 12/2015 |
| CN | 204950366 | U | 1/2016 |
| CN | 204995100 | U | 1/2016 |
| CN | 205053603 | U | 3/2016 |
| CN | 105800070 | A | 7/2016 |
| CN | 105982483 | A | 10/2016 |
| CN | 105996666 | A | 10/2016 |
| CN | 105996669 | A | 10/2016 |
| CN | 106256709 | A | 12/2016 |
| CN | 106347833 | A | 1/2017 |
| CN | 106388488 | A | 2/2017 |
| CN | 106628569 | A | 5/2017 |
| CN | 106829173 | A | 6/2017 |
| CN | 106880247 | A | 6/2017 |
| CN | 304174779 | | 6/2017 |
| CN | 304174781 | | 6/2017 |
| CN | 106938737 | A | 7/2017 |
| CN | 106983331 | A | 7/2017 |
| CN | 107021291 | A | 8/2017 |
| CN | 206414187 | U | 8/2017 |
| CN | 107140307 | A | 9/2017 |
| CN | 107284836 | A | 10/2017 |
| CN | 107307708 | A | 11/2017 |
| CN | 107458744 | A | 12/2017 |
| CN | 107518724 | A | 12/2017 |
| CN | 107600679 | A | 1/2018 |
| CN | 207613584 | U | 7/2018 |
| CN | 207653777 | U | 7/2018 |
| CN | 305134562 | | 4/2019 |
| CN | 305134590 | | 4/2019 |
| CN | 305164032 | | 5/2019 |
| CN | 305225592 | | 6/2019 |
| CN | 305230170 | | 6/2019 |
| CN | 305234390 | | 6/2019 |
| CN | 110015498 | A | 7/2019 |
| CN | 305239321 | | 7/2019 |
| CN | 305239322 | | 7/2019 |
| CN | 305248208 | | 7/2019 |
| CN | 305263586 | | 7/2019 |
| CN | 305263588 | | 7/2019 |
| CN | 305268227 | | 7/2019 |
| CN | 305279093 | | 7/2019 |
| CN | 305279127 | | 7/2019 |
| CN | 305289701 | | 8/2019 |
| CN | 305295091 | | 8/2019 |
| CN | 305324495 | | 8/2019 |
| CN | 305335307 | | 9/2019 |
| CN | 305345691 | | 9/2019 |
| CN | 305354337 | | 9/2019 |
| CN | 305379355 | | 10/2019 |
| CN | 305384119 | | 10/2019 |
| CN | 305406122 | | 10/2019 |
| CN | 110520364 | A | 11/2019 |
| CN | 209617939 | U | 11/2019 |
| CN | 110720738 | A | 1/2020 |
| CN | 305528302 | | 1/2020 |
| CN | 305534561 | | 1/2020 |
| CN | 305534589 | | 1/2020 |
| CN | 305648538 | | 3/2020 |
| CN | 305648539 | | 3/2020 |
| CN | 305648540 | | 3/2020 |
| CN | 305648541 | | 3/2020 |
| CN | 305658953 | | 3/2020 |
| CN | 305658989 | | 3/2020 |
| CN | 305667127 | | 3/2020 |
| CN | 210276755 | U | 4/2020 |
| DE | 8411995 | U1 | 8/1984 |
| DE | 102006060143 | B3 | 7/2008 |
| DE | 202015100294 | U1 | 4/2016 |
| EM | 001733494-0001 | | 8/2010 |
| EM | 001269435-0001 | | 4/2011 |
| EM | 001299028-0001 | | 12/2011 |
| EM | 002079541-0001 | | 7/2012 |
| EM | 002129353-0001 | | 1/2013 |
| EM | 002237248-0001 | | 5/2013 |
| EM | 002298976-0001 | | 10/2013 |
| EM | 001403406-0002 | | 2/2014 |
| EM | 001980707-0001 | | 7/2014 |
| EM | 001980707-0003 | | 7/2014 |
| EM | 001980707-0004 | | 7/2014 |
| EM | 001980996-0001 | | 7/2014 |
| EM | 001980996-0002 | | 7/2014 |
| EM | 002491571-0001 | | 8/2014 |
| EM | 002491571-0002 | | 8/2014 |
| EM | 001426886-0001 | | 1/2015 |
| EM | 002573394-0001 | | 2/2015 |
| EM | 002582833-0002 | | 2/2015 |
| EM | 002624429-0001 | | 2/2015 |
| EM | 002646059-0001 | | 6/2015 |
| EM | 002721829-0001 | | 9/2015 |
| EM | 002721829-0002 | | 9/2015 |
| EM | 002272427-0001 | | 1/2016 |
| EM | 004373694-0002 | | 11/2017 |
| EM | 004394930-0001 | | 11/2017 |
| EM | 004394930-0002 | | 11/2017 |
| EM | 004394930-0003 | | 11/2017 |
| EM | 004394930-0004 | | 11/2017 |
| EM | 004539732-0004 | | 12/2017 |
| EM | 004694230-0001 | | 4/2018 |
| EM | 005325321-0002 | | 9/2018 |
| EM | 005508413-0001 | | 9/2018 |
| EM | 005508413-0002 | | 9/2018 |
| EM | 002573451-0001 | | 2/2019 |
| EM | 007144043-0001 | | 11/2019 |

(56) References Cited

FOREIGN PATENT DOCUMENTS

| | | | |
|---|---|---|---|
| EP | 0158244 | A1 | 10/1985 |
| EP | 1086024 | A1 | 3/2001 |
| EP | 1095599 | A2 | 5/2001 |
| EP | 1427646 | A1 | 6/2004 |
| EP | 1619134 | A1 | 1/2006 |
| EP | 1892194 | A1 | 2/2008 |
| EP | 2213584 | A1 | 8/2010 |
| EP | 2252525 | A2 | 11/2010 |
| EP | 2271559 | A1 | 1/2011 |
| EP | 2512948 | A1 | 10/2012 |
| EP | 2694387 | A1 | 2/2014 |
| EP | 3045402 | A1 | 7/2016 |
| EP | 3380408 | A1 | 10/2018 |
| EP | 3458376 | A1 | 3/2019 |
| EP | 3526131 | A1 | 8/2019 |
| EP | 3305680 | B1 | 9/2019 |
| EP | 3612460 | A1 | 2/2020 |
| ES | 2751171 | T3 | 3/2020 |
| FR | 932677-001 | | 10/1993 |
| FR | 932677-002 | | 10/1993 |
| FR | 014152-002 | | 9/2001 |
| FR | 051792-001 | | 7/2005 |
| FR | 20123568-001 | | 9/2012 |
| FR | 20133228-001 | | 9/2013 |
| IN | 04968DN2012 | | 6/2012 |
| JP | 59059470 | | 10/1985 |
| JP | 3128166 | B2 | 1/2001 |
| JP | 3158283 | B2 | 4/2001 |
| JP | 3173973 | B2 | 6/2001 |
| JP | 3202797 | B2 | 8/2001 |
| JP | 2004315009 | A | 11/2004 |
| JP | 2007126186 | A | 5/2007 |
| JP | 3937428 | B2 | 6/2007 |
| JP | 2008-023202 | A | 2/2008 |
| JP | 4133261 | B2 | 8/2008 |
| JP | 4240529 | B2 | 3/2009 |
| JP | 4470224 | B2 | 6/2010 |
| JP | 2011093544 | A | 5/2011 |
| JP | 5125157 | B2 | 1/2013 |
| JP | 2013056680 | A | 3/2013 |
| JP | 2013071745 | A | 4/2013 |
| JP | 2013514243 | A | 4/2013 |
| JP | 5257503 | B2 | 8/2013 |
| JP | 5312542 | B2 | 10/2013 |
| JP | 5466284 | B1 | 4/2014 |
| JP | 5488630 | B2 | 5/2014 |
| JP | 5503042 | B1 | 5/2014 |
| JP | 5525078 | B1 | 6/2014 |
| JP | 5556937 | B2 | 7/2014 |
| JP | 5670474 | B2 | 2/2015 |
| JP | 2015231852 | A | 12/2015 |
| JP | 5955890 | B2 | 7/2016 |
| JP | 6027647 | B1 | 11/2016 |
| JP | 2017001741 | A | 1/2017 |
| JP | 2017030829 | A | 2/2017 |
| JP | 1573891 | S | 4/2017 |
| JP | 6509783 | B2 | 5/2019 |
| JP | 6554356 | B2 | 7/2019 |
| JP | 6621163 | B1 | 12/2019 |
| JP | 6652876 | B2 | 2/2020 |
| JP | 6681745 | B2 | 4/2020 |
| KR | 200257234 | | 12/2001 |
| KR | 20040038453 | A | 5/2004 |
| KR | 20090047212 | A | 5/2009 |
| KR | 20120092701 | A | 8/2012 |
| KR | 200480924 | Y1 | 7/2016 |
| KR | 301011307.0000 | | 2/2018 |
| KR | 102030349 | B1 | 10/2019 |
| KR | 102070820 | B1 | 1/2020 |
| KR | 102087527 | B1 | 3/2020 |
| NL | 8401096 | A | 11/1985 |
| RU | 2012129983 | A | 1/2014 |
| SG | 181475 | A1 | 7/2012 |
| TW | 201125786 | A | 8/2011 |
| TW | I516421 | B | 1/2016 |
| TW | 201936455 | A | 9/2019 |
| WO | D015800-001 | | 4/1990 |
| WO | D029984-001 | | 8/1994 |
| WO | 0146032 | A2 | 6/2001 |
| WO | 04094239 | A2 | 11/2004 |
| WO | 09141700 | A1 | 11/2009 |
| WO | 10085137 | A2 | 7/2010 |
| WO | 11084445 | A1 | 7/2011 |
| WO | 14004200 | A1 | 1/2014 |
| WO | 14184341 | A1 | 11/2014 |
| WO | D091871-001 | | 10/2016 |
| WO | D091871-002 | | 10/2016 |
| WO | D091871-003 | | 10/2016 |
| WO | D091871-004 | | 10/2016 |
| WO | 17068151 | A1 | 4/2017 |
| WO | 17107368 | A1 | 6/2017 |
| WO | 2017192768 | A1 | 11/2017 |
| WO | 17214161 | A1 | 12/2017 |
| WO | 18209992 | A1 | 11/2018 |
| WO | 19038269 | A1 | 2/2019 |
| WO | 19115326 | | 6/2019 |
| WO | 19122325 | | 6/2019 |
| WO | 19147866 | | 8/2019 |
| WO | 19165529 | | 9/2019 |
| WO | 19165530 | | 9/2019 |
| WO | 19168954 | | 9/2019 |

OTHER PUBLICATIONS https://healthyhumanlife.com/products/flip-n-sip-lid dated Apr. 15, 2020.

AUTOSEAL® Fit dated Apr. 14, 2020.

Jan. 20, 2021—(WO) International Search Report & Written Opinion—PCT/US20/044969.

Non-Slip Rubber-Coated Push-Button Water Bottle With Carry Handle 48 oz.

* cited by examiner

LID FOR CONTAINER

CROSS REFERENCE TO RELATED APPLICATION

The present application relates to U.S. Application No. 62/352,330 filed on Jun. 20, 2016, U.S. application Ser. No. 15/197,180 filed on Jun. 29, 2016, U.S. application Ser. No. 15/628,442, filed on Jun. 20, 2017, and U.S. application Ser. No. 15/628,390, filed on Jun. 20, 2017, each of which is hereby incorporated fully by reference for any and all non-limiting purposes.

BACKGROUND

Beverage containers are popular and can be used for many different activities. Lids can be included on beverage containers to prevent the contents from spilling and to prevent contaminates from entering into the beverage container. One feature that may be included in a beverage lid is access to the contents of the container without having to completely remove the lid from the bottle.

BRIEF SUMMARY

This Summary is provided to introduce a selection of concepts in a simplified form that are further described below in the Detailed Description. The Summary is not intended to identify key features or essential features of the claimed subject matter, nor is it intended to be used to limit the scope of the claimed subject matter.

In certain examples, a lid can include a lid body having an opening and locking projection and a flip cover may include a flip cover flange where the flip cover can be configured to cover the opening to prevent contents from spilling. A release mechanism can include a latching mechanism for receiving the flange of the flip cover to secure the flip cover in the closed position. A locking slider may include an arm having a distal end that can be configured to interfere with the locking projection of the lid body to prevent the release mechanism from rotating and releasing the flip cover. The locking slider can be displaced such that the distal end of the arm moves away from the locking projection of the lid body And the release mechanism is permitted to move the latching mechanism away from the flip cover flange, and the flip cover can be moved into an open position.

BRIEF DESCRIPTION OF THE DRAWINGS

The present disclosure is illustrated by way of example and not limited in the accompanying figures in which like reference numerals indicate similar elements and in which.

Further, it is to be understood that the drawings may represent the scale of different components of various examples; however, the disclosed examples are not limited to that particular scale.

DETAILED DESCRIPTION

In the following description of the various examples, reference is made to the accompanying drawings, which form a part hereof, and in which is shown by way of illustration various examples in which aspects of the disclosure may be practiced. It is to be understood that other examples may be utilized and structural and functional modifications may be made without departing from the scope and spirit of the present disclosure. In the following description of the various embodiments, reference is made to the accompanying drawings, which form a part hereof, and in which is shown by way of illustration various embodiments in which aspects may be practiced. Also references to "embodiment," "example," etc., indicate that the embodiment(s) or example(s) of the invention so described may include particular features, structures, or characteristics, but not every embodiment or example necessarily includes the particular features, structures, or characteristics. Further, it is contemplated that certain embodiments or examples may have some, all, or none of the features described for other embodiments. And it is to be understood that other embodiments may be utilized and structural and functional modifications may be made without departing from the scope of the present disclosure.

Also, while the terms "front," "rear," "top," "base," "bottom," "side," "forward," and "rearward" and the like may be used in this specification to describe various example features and elements, these terms are used herein as a matter of convenience, e.g., based on the example orientations shown in the figures and/or the orientations in typical use. Nothing in this specification should be construed as requiring a specific three dimensional or spatial orientation of structures in order to fall within the scope of the claims.

Figure 1:
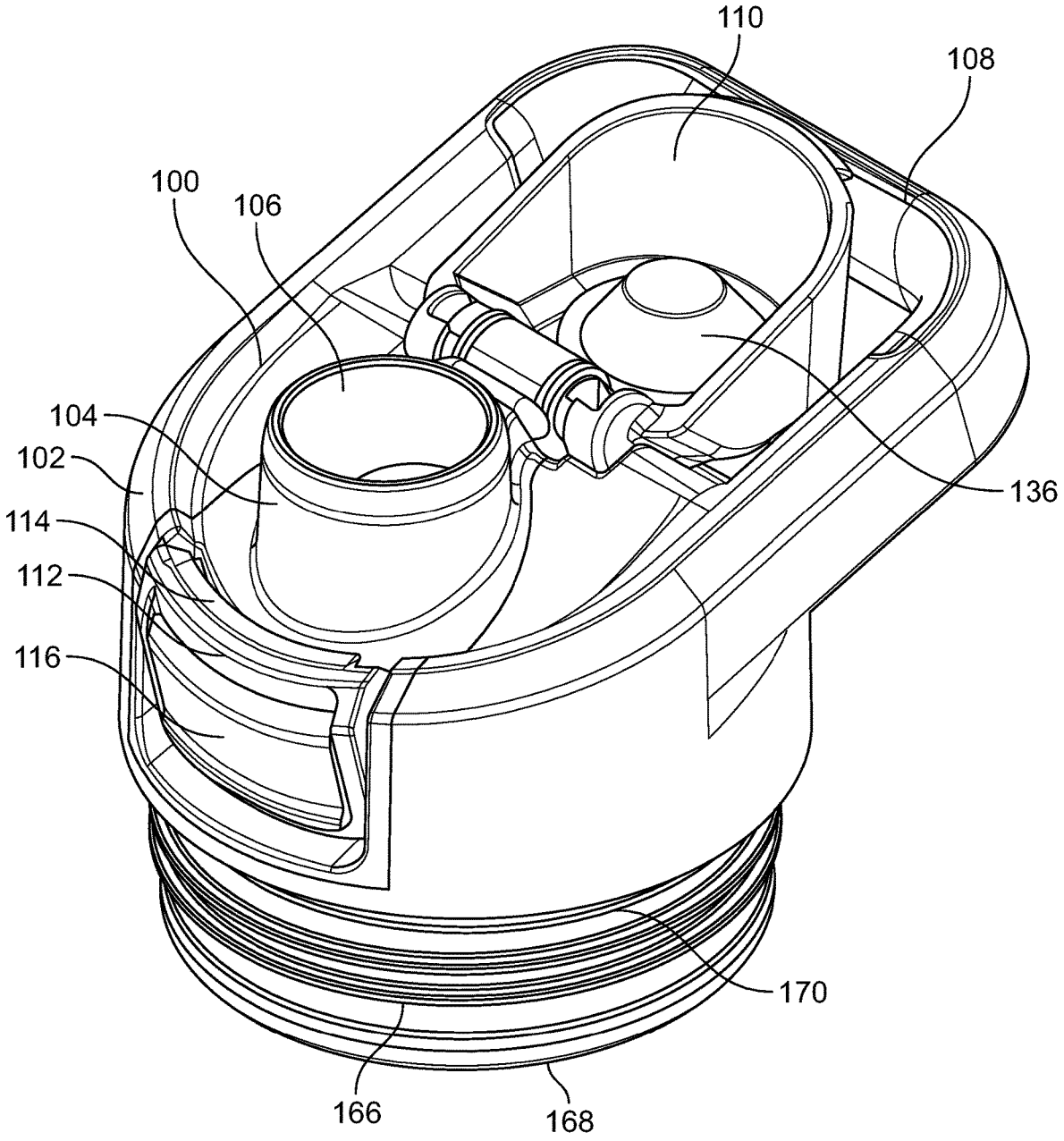
FIG. 1 depicts an isometric view of an example lid in an opened position.

FIG. 1 depicts an isometric view of a lid 100. In this example the lid may include a lid body 102. The lid body 102 can include a pour spout 104 having an opening 106 for liquids and a handle 108 in a U-shaped configuration. The lid 100 may also include a flip cover 110 for covering and sealing the opening 106 of the pour spout 104. The lid 100 can also include a release mechanism 112 with a latch 114 for releasing the flip cover 110. And the release mechanism 112 may include a lockout slider or locking slider 116 for preventing the release mechanism 112 from inadvertently releasing the cover 110.

Lid Body

Figure 2:
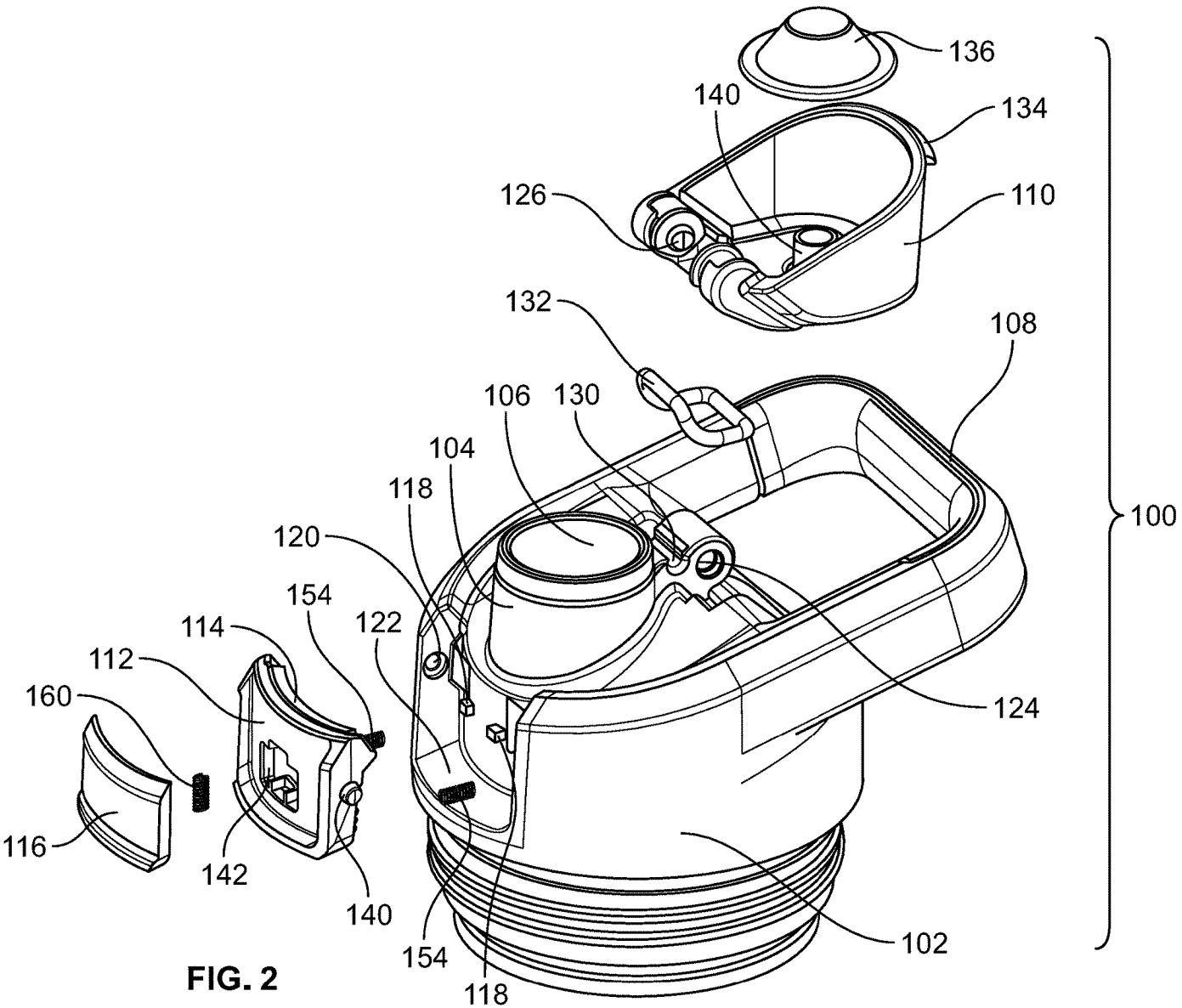
FIG. 2 depicts an exploded isometric view of the example lid of FIG. 1 in an opened position

Referring now to FIG. 2, which depicts an exploded view of the lid 100, the front of the lid body 102 can include a U-shaped slot 122 for receiving release mechanism 112 and locking slider 116. The lid body 102 is provided with handle U-shaped 108 extending rearwardly on the lid body 102. Also adjacent to the handle 108 is a slot 124 for receiving a pair of pivot boss features 126 located in cover 110. The slot 124 can be provided in a projection 128 on the lid body 102. Also, the projection 128 of the lid body 102 can include a channel 130 defined on its surface. The channel 130 is configured to receive a band 132. And the band 132 can be elastic in nature and can be configured to bias the cover 110 into the opened position so as to not interfere with the user's access to the pour spout 104 when the user is consuming contents through spout 104. As shown in FIG. 2, the lid body 102 can also include first and second locking projections 118. As discussed herein, the first and second locking projections 118 can prevent the release mechanism 112 from rotating and releasing the cover 110. The lid body 102 may also include inner circular openings 120. These openings are configured to receive pins or posts located on the outside of the release mechanism 112. Also the lid body 102 may include threads 166 for securing the lid 100 to a container and a pair of gaskets 168, 170 to seal the lid 100 with a container as is disclosed in U.S. Application Nos. 62/352,330, 15/197,180, 15/628,442, and 15/628,390, incorporated by reference above.

Figure 6:
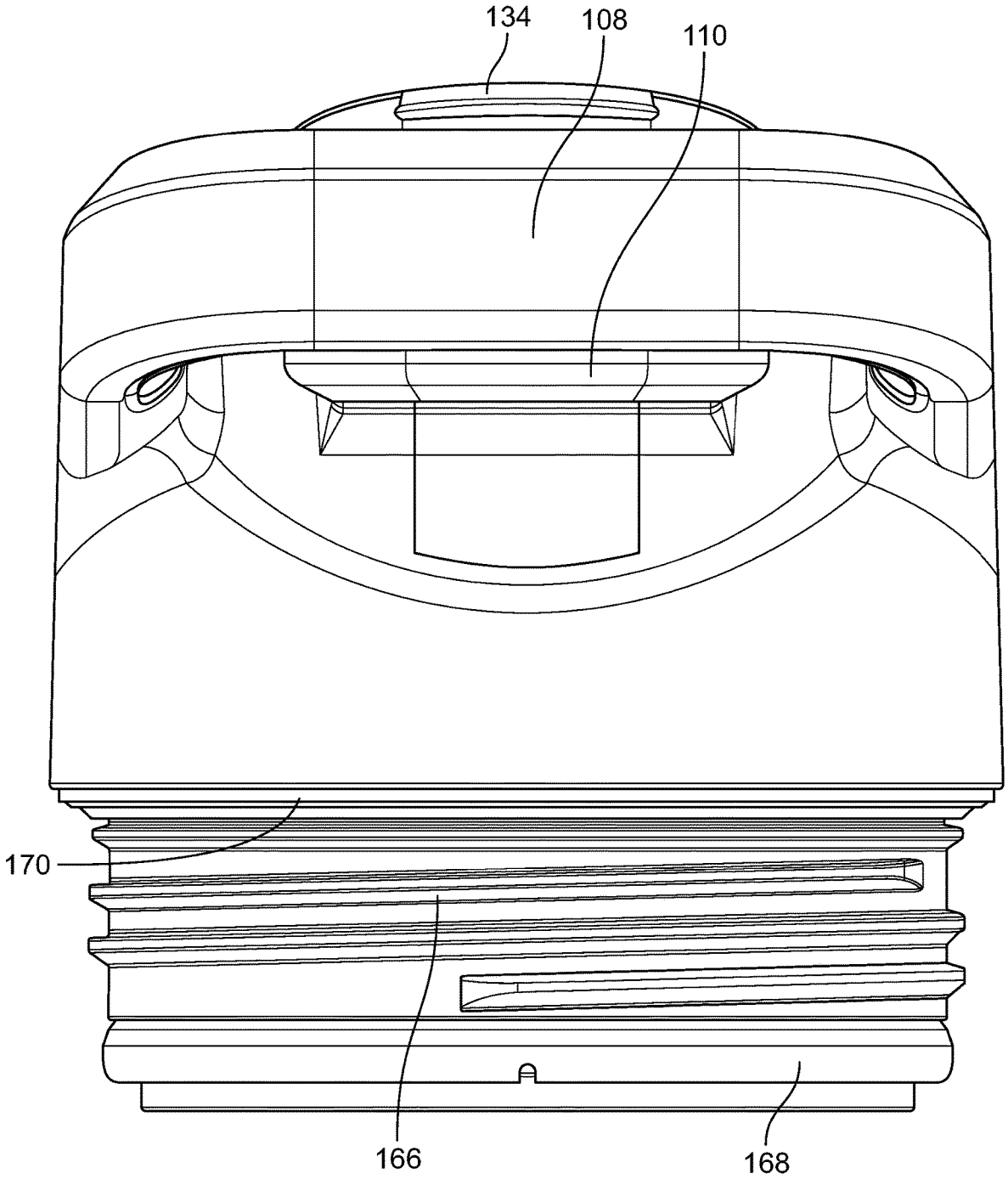
FIG. 6 depicts a rear view of the example lid of FIG. 1 in the opened position.
Figure 6A:
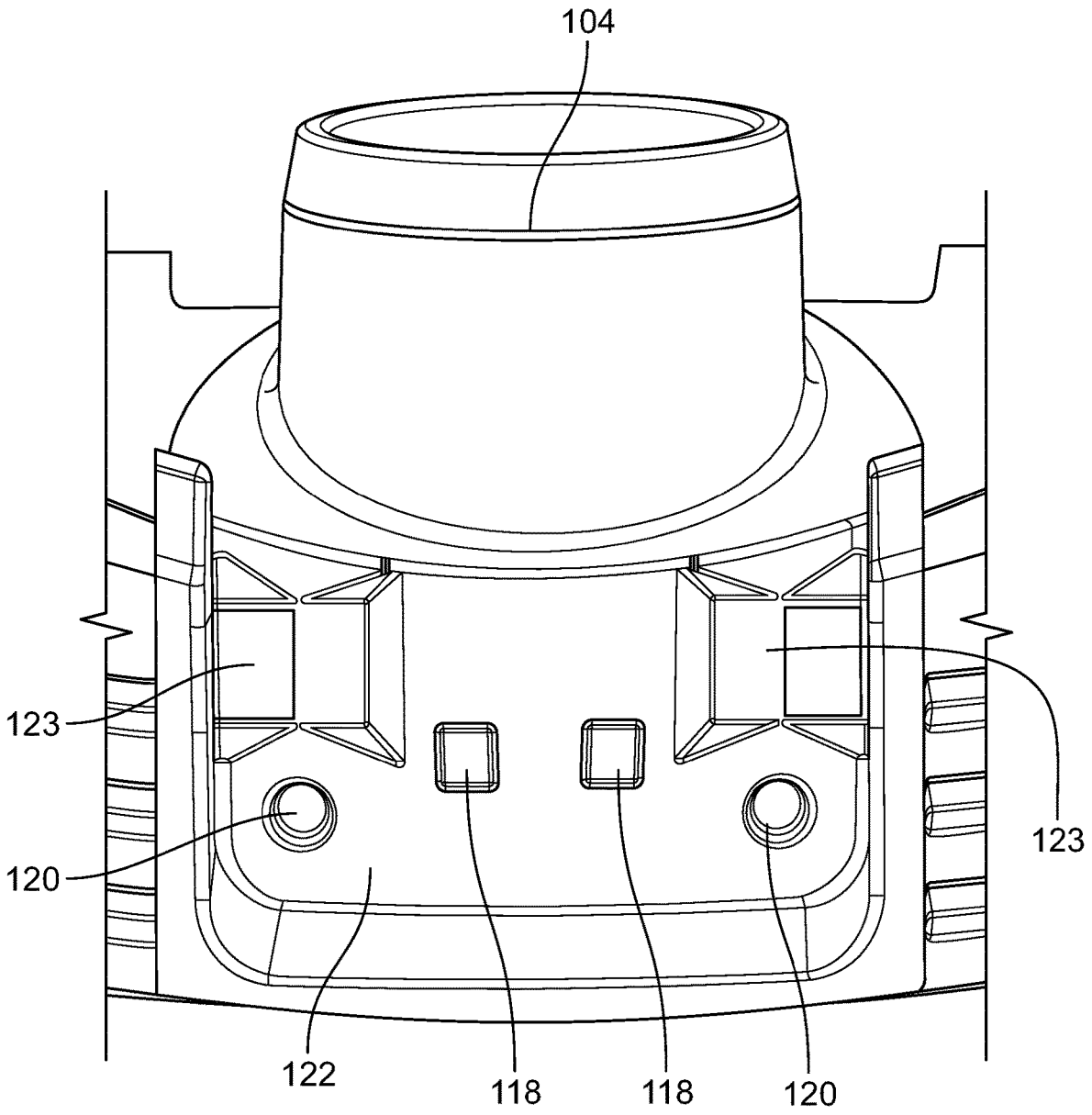
FIG. 6A shows a front view of a portion of the example lid of FIG. 1.

In one example, a front face of the lid body 102 may be provided with a certain shape to avoid debris and contaminants from being caught between the lid body 102 and the release mechanism 112. For example, as shown in FIG. 6A, the U-shaped slot 122 may be provided with a pair of butterfly shaped openings 123 to help prevent debris and contaminates from becoming trapped between the release mechanism 112 and the lid body 102. The butterfly openings 123 can be provided with a series of faces to reduce the number of ledges and angles to help prevent debris and contaminates from being trapped in this area between the lid body face and the release mechanism 112. But if contaminants and debris are lodged behind the release mechanism, the configuration of the lid body can help to make this surface easier to clean in that the number of 90 degree angles are reduced that would be harder to clean in this inaccessible area. In this way, soapy water will be able to flow across these surfaces to clean the area of the lid body near the release mechanism 112 and not be impeded with hard direction changes.

Flip Cover

The flip cover 110 is configured to cover pour spout 104 to prevent leakage of contents through the container and for preventing contaminates from entering into the container. The flip cover 110 generally includes flip cover flange 134, gasket 136, and a pivot in the form of pivot boss features 126. The body of the flip cover 110 is configured to cover pour spout 104.

The flip cover flange 134 is configured to engage the latch 114 of the release mechanism 112. The flip cover flange 134 extends forward away from the flip cover body such that the latch 114 of the release mechanism 112 can catch and hold the flip cover 110 into a closed position over the opening 106. In one example, the flip cover flange 134 can have a triangular cross section and a tapered lower section. The tapered lower section, when pressed into the latch 114 of the release mechanism 112, can allow the latch 114 to rotate over the flip cover flange 134. So the bottom surface of the latch 114 engages the top surface of the flip cover flange 134 and holds the flip cover 110 in the closed position on the container lid body 102.

Also when the latch 114 engages the flip cover flange 134, the gasket 136 on the underside of the flip cover 110 is pressed into the opening 106 of the pour spout 104. And the cover gasket 136 is configured to plug the opening 106 of the pour spout 104 to prevent any liquid from exiting the lid 100 through the spout 104 when the flip cover 110 is closed. In one example, the gasket 136 can have a frustoconical shape that tapers downwardly into the opening 106 of the pour spout 104 when the flip cover 110 engages spout 104. And the gasket 136 can include a flange that extends around a lower circumference of the gasket 136. The gasket 136 can be formed of a silicone, TPU, TPE, or EPDM rubber in certain examples. But other suitable elastic may also be used. Silicone may have a wider thermal performance operating temperature in certain instances. And the gasket 136 can be press fit onto a post 140 located within the flip cover 110. Briefly referring to cross-sectional views 11 and 15, the gasket 136 can be provided with a post 162, which in one example can be in the form of a Christmas-tree arrangement. The post 162 can be press fit into a tube 164 within the cover 110 to maintain the gasket 136 on the flip cover 110. However, in another example, a post can be included on the flip cover 110 and a hold can be included on the gasket 136 for additional safety in the device in the off chance that that it blocks an air passage of the user. In one example, the gasket 136 can be configured to be removeable such that the user can clean the gasket 136. It is also contemplated that the gasket 136 can be replaceable by the user when corroded or damaged. In other examples, the gasket 136 can be permanently affixed to the cover 110, for example, with an adhesive.

In one example, the flip cover 110 is secured to the lid body 102 with pivot boss features 126 that form a hinge. The pivot boss features 126 extend inwardly or internally from an end of the flip cover 110. Yet the pivot boss features 126 do not connect to form a continuous axle. Separate pivot boss features 126 can be advantageous as opposed to a continuous axle extending through the lid body 102 in that the pivot boss features 126 provide for better removability of the flip cover 110 from the lid body 102. For example, utilizing the pivot boss features instead of an elongated axle that extends through the lid body can in certain instances make it easier for the user to be able to remove the flip cover 110 and clean the crevasses of the flip cover 110 or replace the band 132 or gasket 136.

Figure 3:
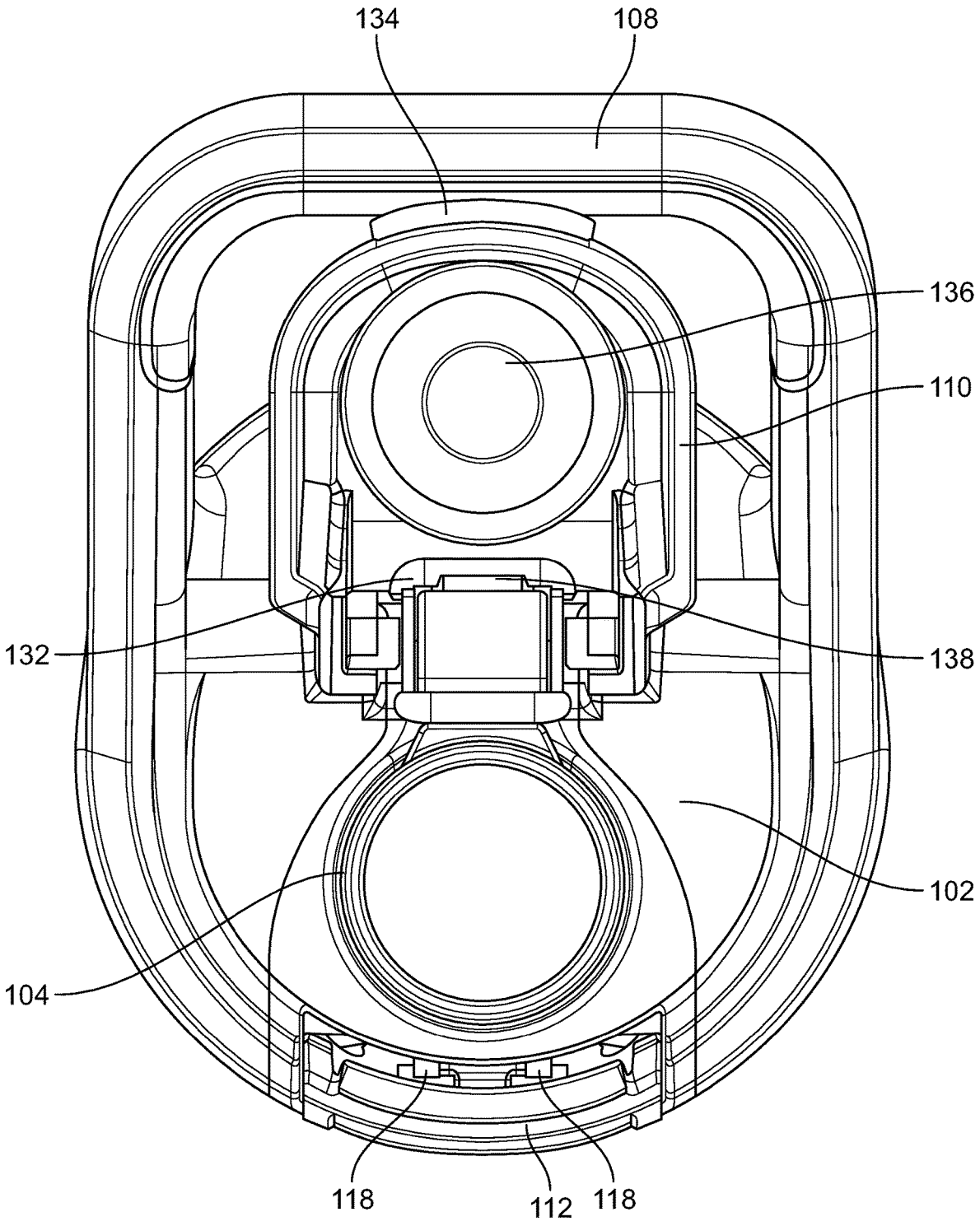
FIG. 3 depicts a top view of the example lid of FIG. 1 in an opened position.
Figure 4:
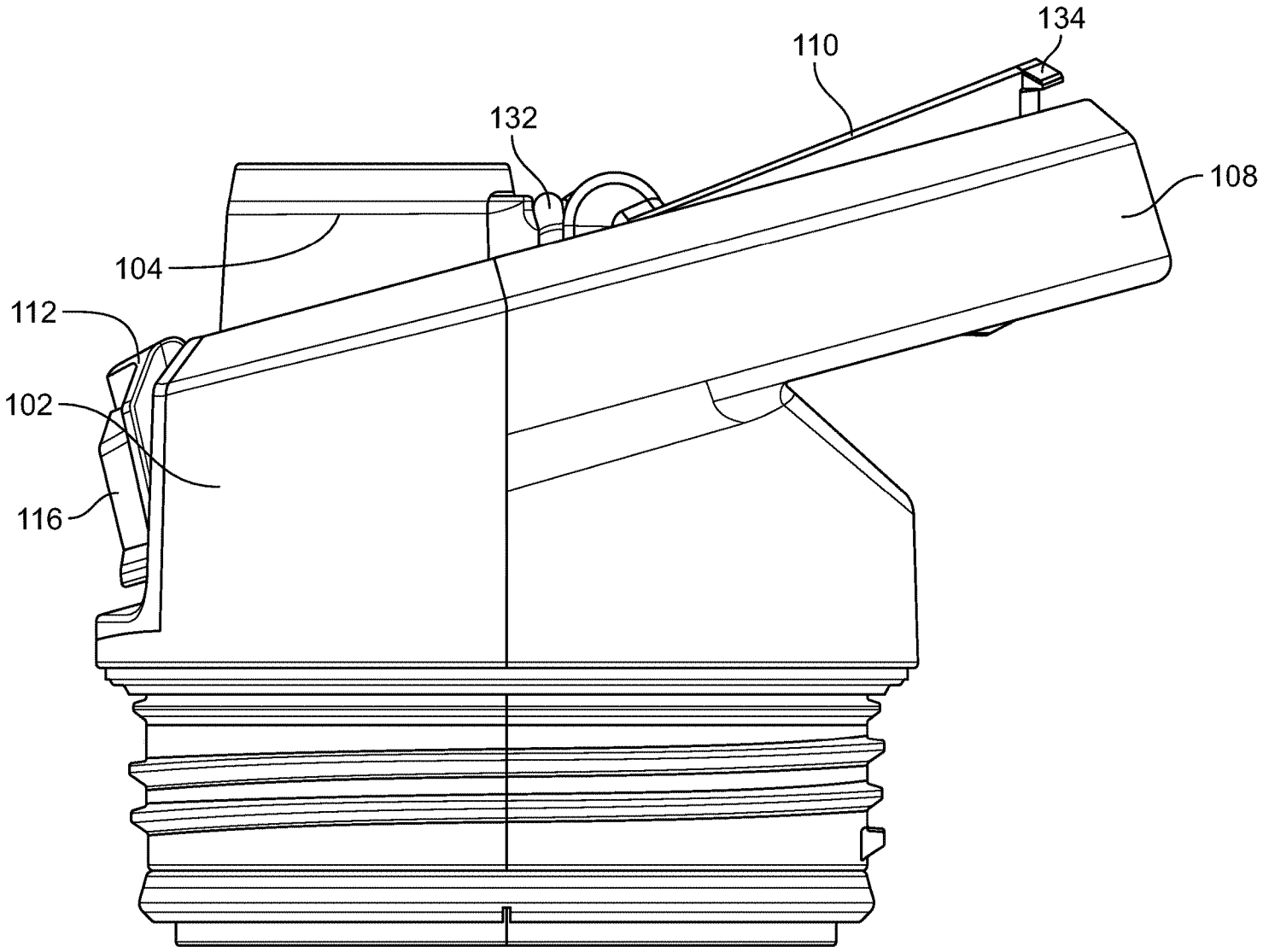
FIG. 4 depicts a side view of the example lid of FIG. 1 in the opened position.
Figure 5:
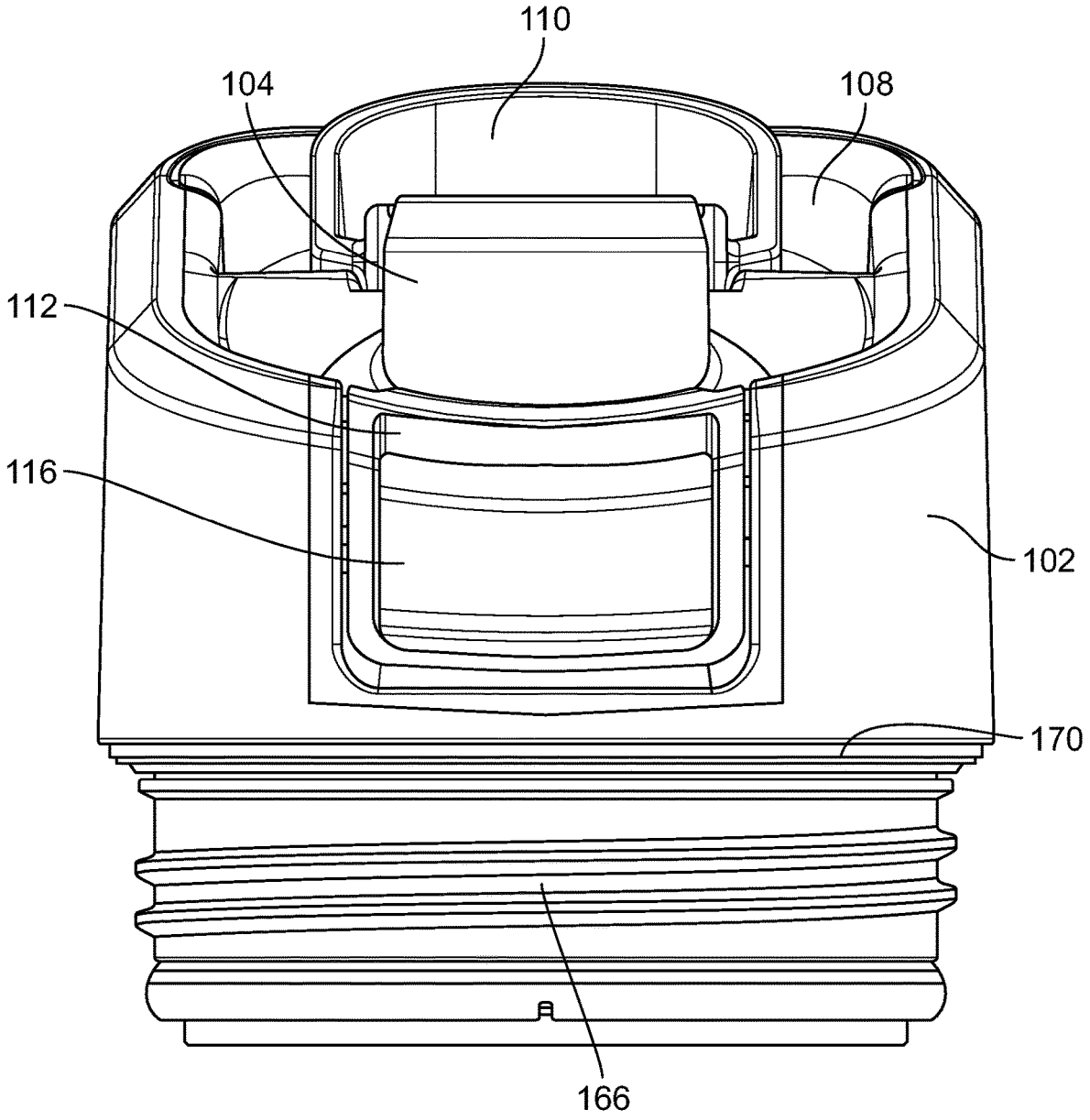
FIG. 5 depicts a front view of the example lid of FIG. 1 in the opened position.

Also the flip cover 110 can be biased toward the opened position by the band 132, which in one example can be formed of silicon or other suitable materials. As shown in FIG. 3, the band 132 can be positioned within a notch 138 located in the flip cover 110 and in the channel 130 defined in the lid body 102. And the band 132 can be provided with enough tension such that when the flip cover 110 is released, the flip cover 110 rotates to an opened position, e.g. the position shown in FIG. 1.

Release Mechanism

Figure 7:
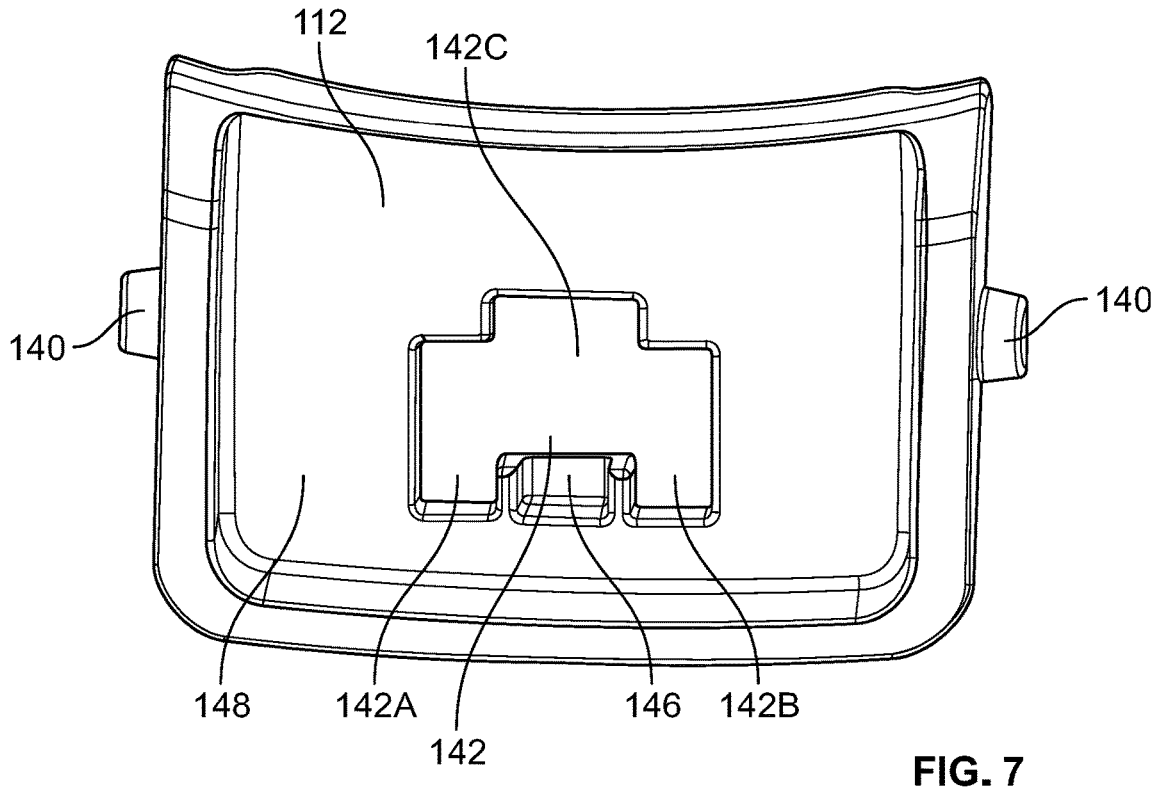
FIG. 7 depicts a front perspective view of an example releasing mechanism that can be used in conjunction with the lid of FIG. 1.
Figure 8:
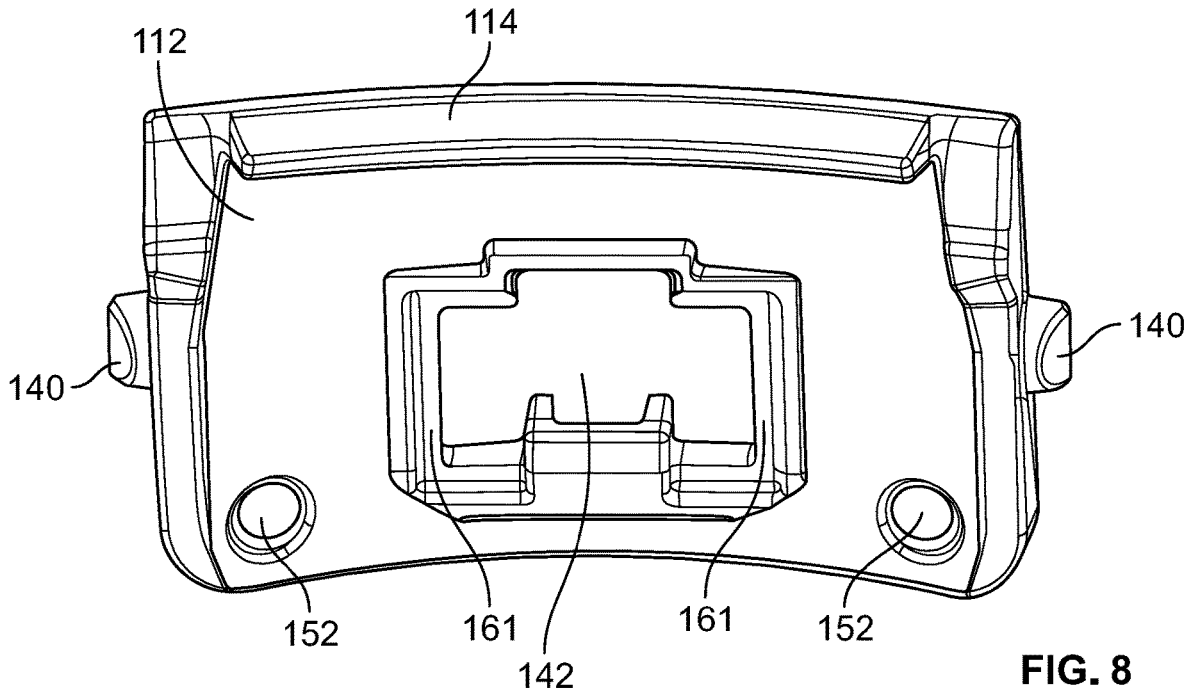
FIG. 8 shows a rear view of an example releasing mechanism that can be used in conjunction with the lid of FIG. 1.
Figure 9:
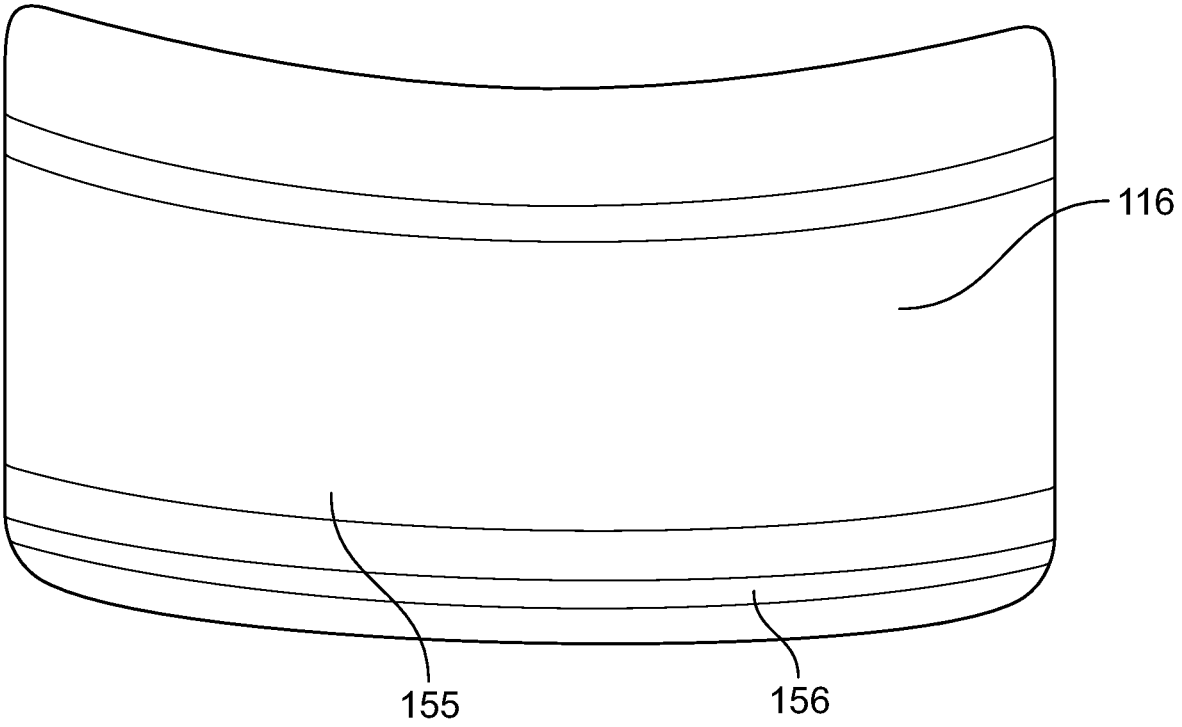
FIG. 9 shows a front view of an example locking slider that can be used in conjunction with the lid of FIG. 1.
Figure 10:
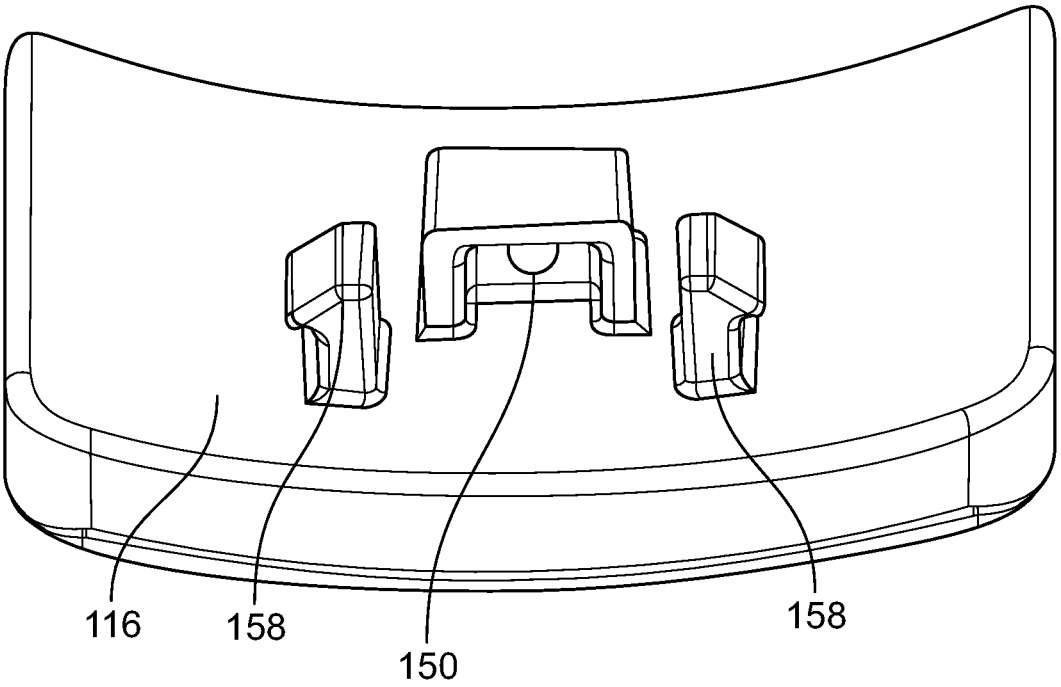
FIG. 10 shows a rear view of an example locking slider that can be used in conjunction with the lid of FIG. 1.

As discussed herein, the release mechanism or button 112 is configured to release the flip cover 110 to expose the opening 106 of the pour spout 104. FIGS. 7 and 8 illustrate the release mechanism 112 individually. The release mechanism includes posts 140, opening 142, latch 114, lower pocket 146, and recessed front face 148.

The release mechanism 112 can include a pivot, which comprises the pair of posts or pins 140, which can be mounted in two circular openings 120 provided in the lid body 102. As such, when mounted on the lid body 102, the release mechanism 112 is allowed to pivot on the lid body 102. It is also contemplated that the posts or pins 140 can provide the release mechanism 112 with the ability to be removed from the lid body 102 such that the U-shaped slot 122 can be cleaned for example. The use of the posts or pins 140 can make the release mechanism 112 easier to remove from the lid body 102 than an elongated axle or shaft extending through the release mechanism 112.

Latch 114 extends reward of the release mechanism 112, and as discussed herein, the latch 114 is configured to interact and engage the flip cover flange 134 to retain the flip cover 110 into a closed position. Specifically, the underside of the release mechanism engages the flip cover flange 134 to retain the flip cover 110 into a closed position. In one example, the upper surface can extend at an angle from the release mechanism 112 body in order to allow the latch 114 to move over the flip cover flange 134 into the latched position. In one example, the underside surface of the latch 114 extends at approximately 90 degrees from the body of the release mechanism and the upper surface of the latch 114 extends at approximately 30 degrees at an upper ridge, but other angles are also contemplated.

The release mechanism 112 also includes a recessed front face 148 which receives the locking slider 116. The release mechanism 112 also includes an opening 142 that extends through a face of the release mechanism 112. The opening 142 is configured to receive two arms 158 of the locking slider 116 and an upper pocket of the locking slider, as discussed herein. Specifically, the opening 142 has two side portions 142A, 142B, which are configured to receive the two arms 158 of the locking slider 116. Also, the opening 142 includes an upper portion 142C, which is configured to receive a pocket 150 of the locking slider 116. The opening 142 also includes the lower pocket 146. The lower pocket 146 is configured to receive a spring 160 (shown in FIG. 2), which is held between the lower pocket in the release mechanism 112 and the upper pocket 150 in the locking slider 116. In one example, the upper pocket 150 can be U-shaped.

Additionally, as shown in FIG. 8, the rear portion of the release mechanism 112 is provided with a pair of spaced apart openings 152 for receiving a pair of biasing members 154. The pair of biasing members 154 are positioned between the lid body and the release mechanism 112 and are configured to bias the release mechanism 112 into the closed position or latched position.

Locking Slider

As discussed herein, the locking slider 116 is configured to release the release mechanism 112, which is in turn configured to release the flip cover 110 to expose the opening 106 of the pour spout 104. FIGS. 7 and 8 illustrate the locking slider 116 individually. The locking slider 116 includes pressing surface 155, tab 156 on the front face, arms 158 and upper pocket 150 on the rear face.

The arms 158 also can be located in the opening 142 of the release mechanism 112 to limit the rotation of the release mechanism 112 to maintain the cover 110 in the closed position. In one example, the arms 158 of the locking slider 116 include distal ends that are configured to abut against and interfere with the locking projections 118 of the lid body to prevent the release mechanism 112 from rotating and releasing the flip cover 110. Also the arms 158 are allowed to move vertically along the release mechanism within the opening 142 located in the release mechanism 112. To open the flip cover, the locking slider 116 is displaced downwardly such that the distal ends of the arms 158 move down and away from the locking projections 118 of the lid body 102 and the release mechanism 112 is permitted to pivot to move the latch 114 away from the flip cover flange 134 and the flip cover 110 can be moved into an open position.

Also the arms 158 also can be located in the opening 142 of the release mechanism 112 to retain the locking slider 116 in position on the release mechanism 112. In this example, the arms 158 of the locking slider 116 each have a tapered end. And the arms 158 are elastic and configured to be biased away from each other so that the arms 158 interact with the inner walls 161 of the located in the opening 142 of the release mechanism 112 to maintain the locking slider 116 on the release mechanism 112. Also the locking slider 116 is placed into the recessed front face 148, which forms a locking slider recess. As such, the locking slider 116 fits into the recessed front face 148. And the locking slider 116 forms a primary pushing surface or pressing surface 155 for pressing the release mechanism 112 inwardly to release the flip cover 110. The locking slider 116 may also include a tab 156, which provides a means for allowing the user to move the locking slider 116 downwardly in order to move the arms 158 out of the way of the locking projections 118 of the lid body 102.

The locking slider 116 also includes an upper pocket 150, which houses spring 160. In one example, the upper pocket can be U-shaped. In this way, the locking slider 116 is biased upwardly by the spring 160 into a locked position. So when the cover 110 is in a closed position the locking slider 116 arms 158 are in contact with the locking projections 118, the body and the release mechanism 112 is prevented from being rotated inwardly.

Figure 11:
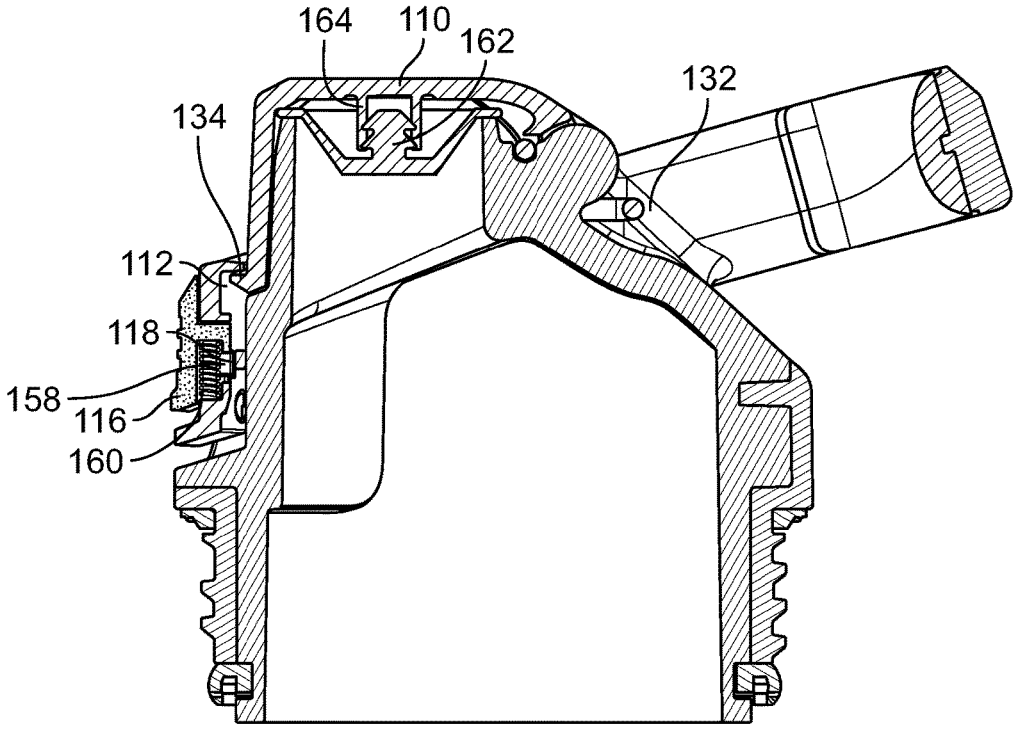
FIG. 11 shows a cross-sectional view of the example lid of FIG. 1 with the lid and release mechanism in a closed position.
Figure 12:
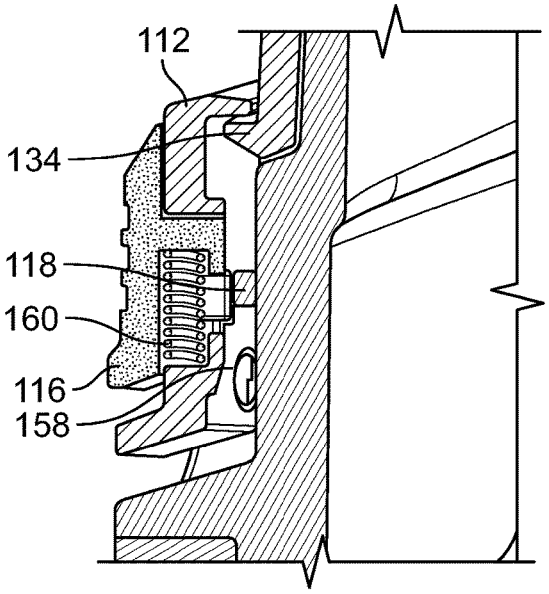
FIG. 12 is an enlarged view of FIG. 11.
Figure 13:
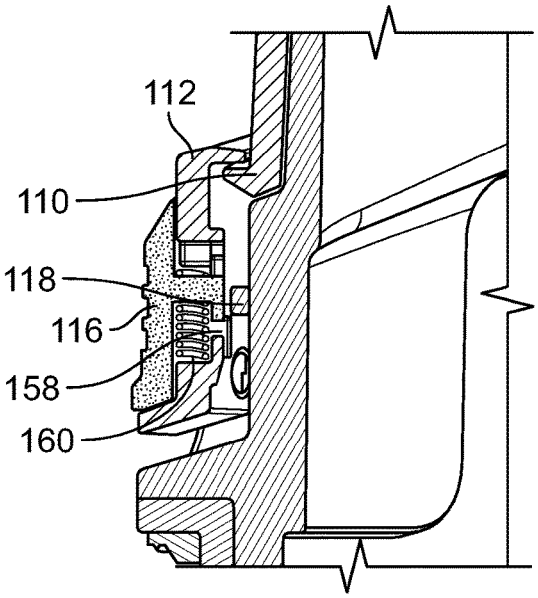
FIG. 13 shows a cross-sectional view of a portion of the example lid of FIG. 1 illustrating the example locking slider in a release position.
Figure 14:
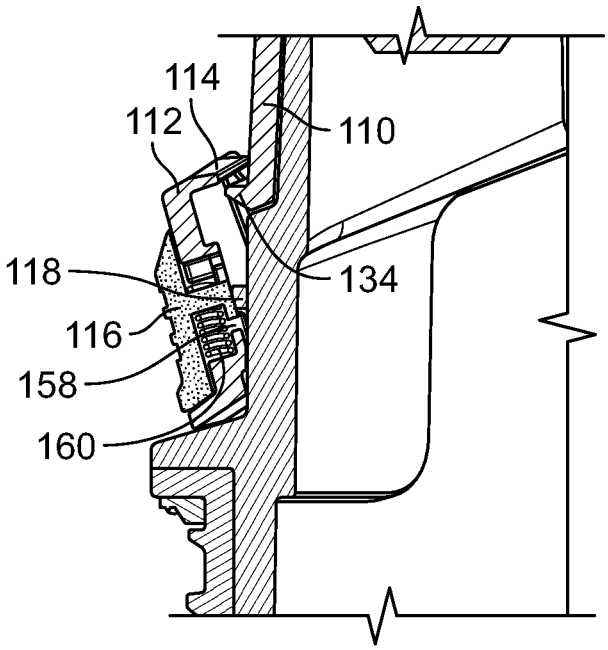
FIG. 14 shows a cross-sectional view of a portion of the example lid of FIG. 1 illustrating the example release mechanism in a released position.
Figure 15:
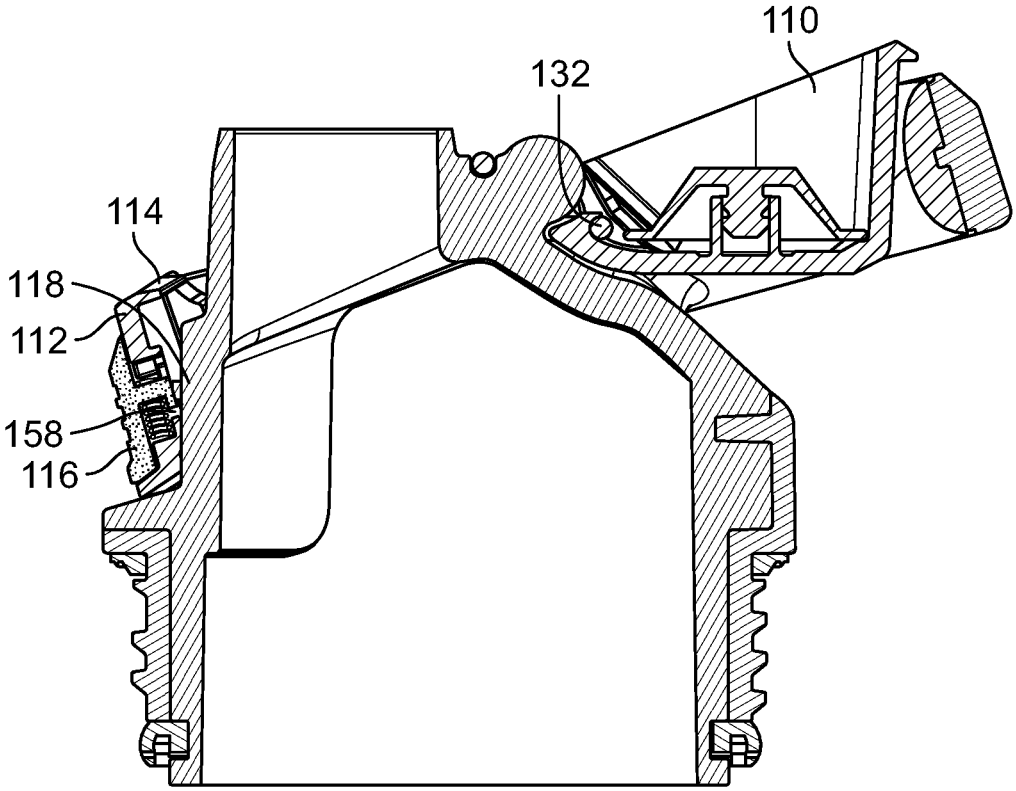
FIG. 15 shows a cross-sectional view of a portion of the example lid of FIG. 1 illustrating the example flip cover in the released position.

FIGS. 11-15 show the lid during use. FIGS. 11 and 12 show the lid 100 in a closed position. When the lid 100 is in the closed position, the release mechanism 112 is incapable of rotating because the arms 158 of the locking slider 116 are in contact with the locking projections 118. As is shown in FIG. 13 as the locking slider 116 is moved downward by the user, the arms 158 are no longer in contact with the locking projections 118 of the lid body 102. As is shown in FIG. 14, the locking slider 116 and the release mechanism 112 can be rotated together away from the lid body 102 so that the latch 114 releases the flip cover flange 134. And as the flip cover 110 is released as shown in FIG. 15, the band 132 biases the lid 110 to the opened position and also holds the lid 110 in the opened position.

Once the user releases the release mechanism 112 and sliding lock 116, the spring 160 biases the sliding lock 116 upward along the release mechanism 112. Also springs 154 rotate the release mechanism 112 and the sliding lock 116 together back to the latched position. Then when the user rotates the flip cover to cover the pour spout 104, the flip lid flange 134 is pressed against the upper surface of the latch 114 causing the release mechanism 112 and latch 114 to rotate away from the lid body 102 so that the latch 114 engages the upper surface of the flange 134 of the flip cover 110 and the release mechanism 112 retains the flip lid cover 110 in the closed position.

Figure 16:
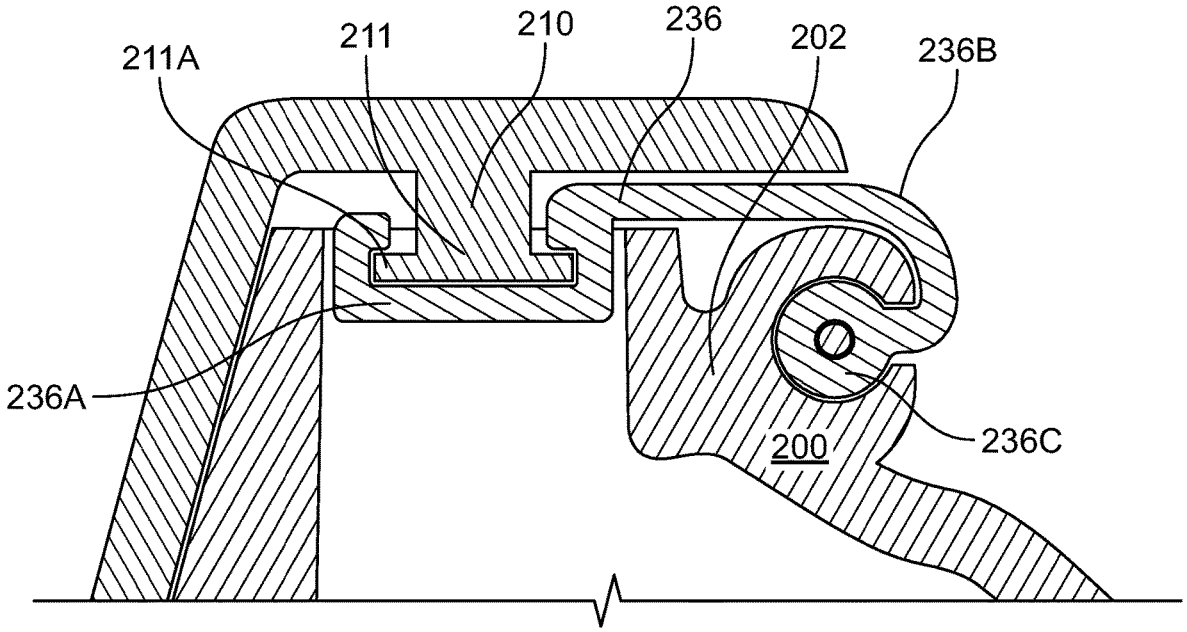
FIG. 16 shows a cross-sectional view of another example lid.
Figure 17:
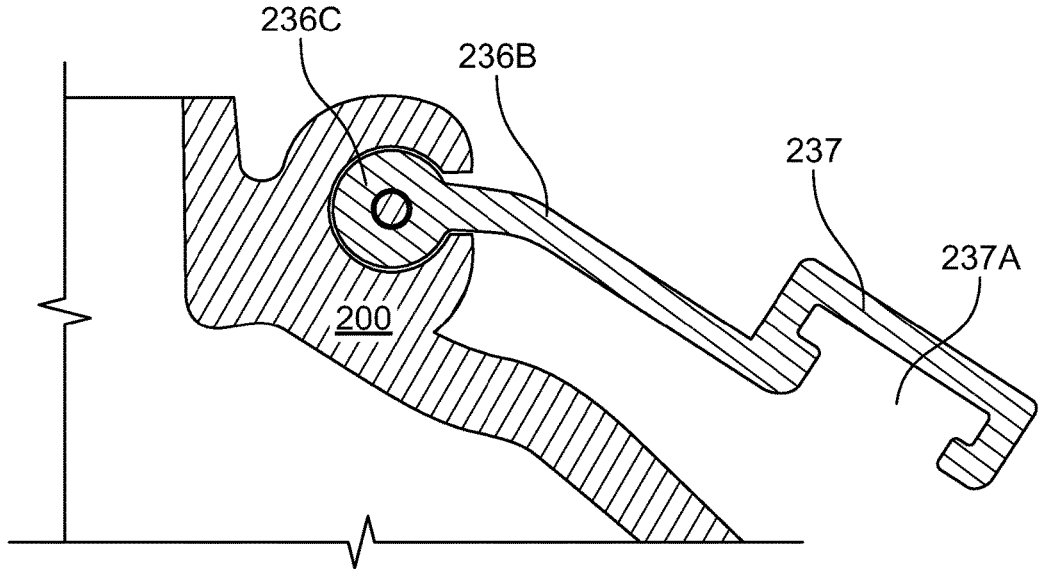
FIG. 17 shows a cross-sectional view of the example lid of FIG. 16 without a flip cover.
Figure 18:
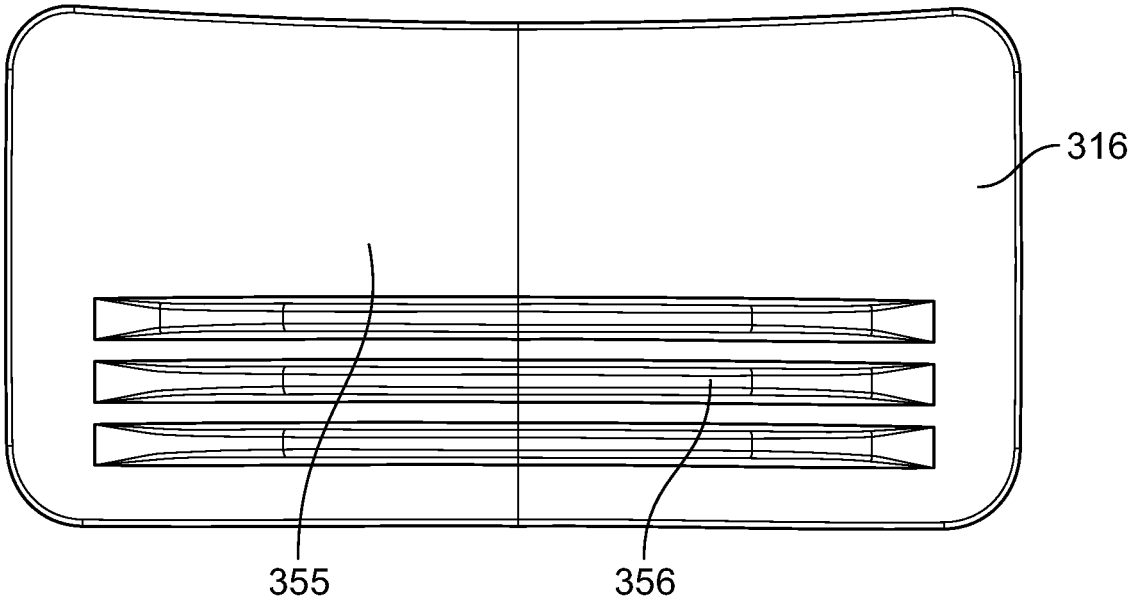
FIG. 18 shows a front view of another example of a locking slider.
Figure 19:
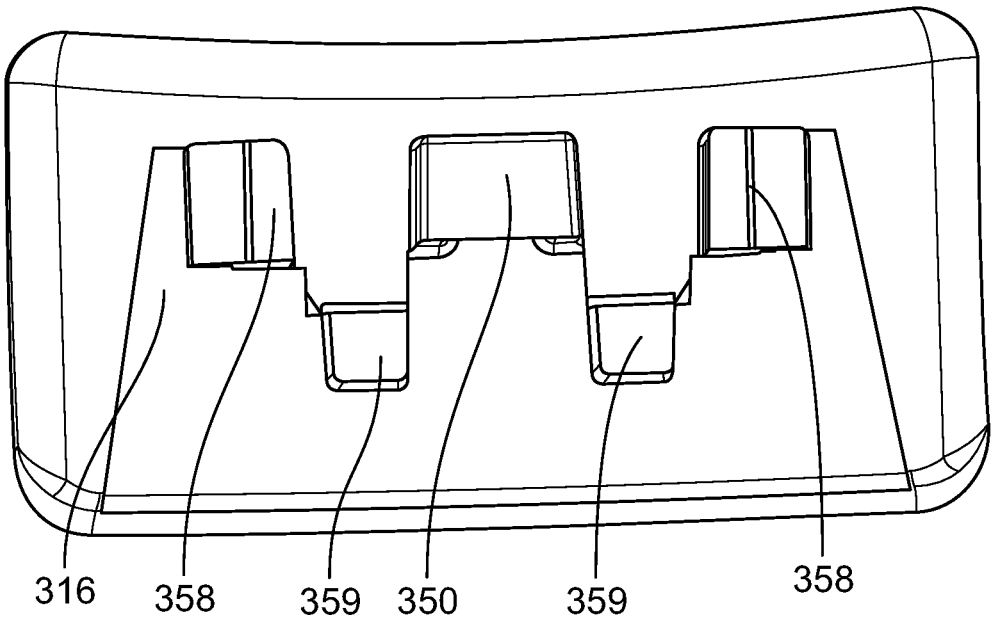
FIG. 19 shows a rear view of the example locking slider of FIG. 18.
Figure 20:
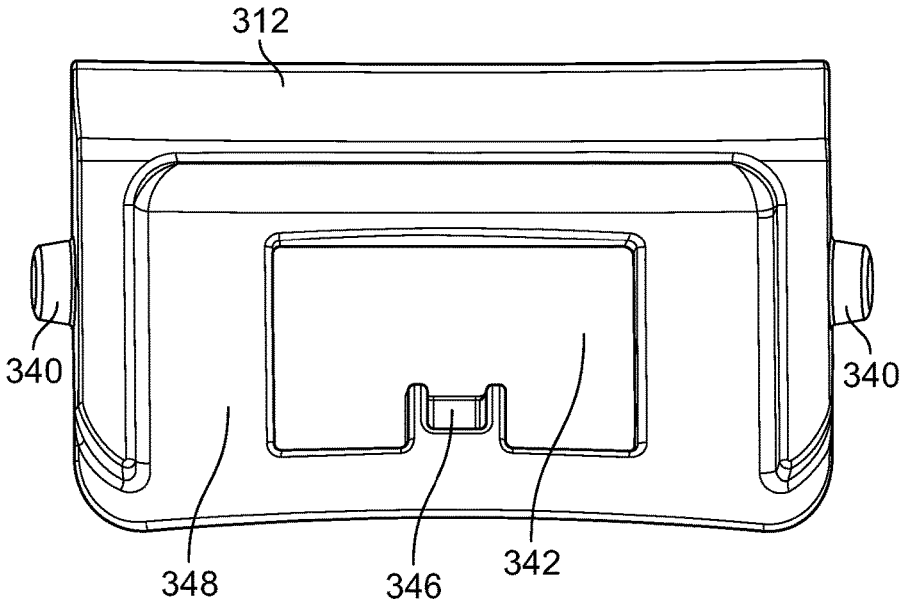
FIG. 20 shows a front of another example release mechanism that can be used in conjunction with the example locking slider of FIG. 18.
Figure 21:
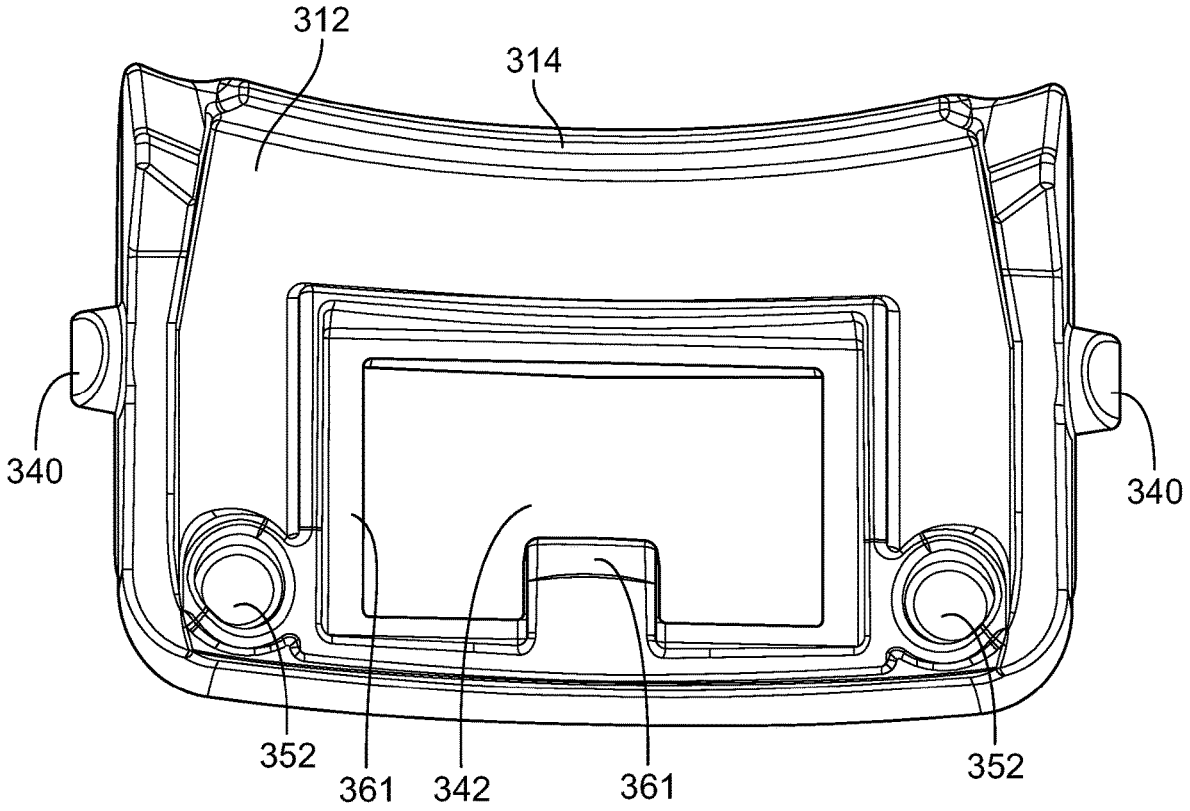
FIG. 21 shows a rear view of the example release mechanism of FIG. 20.

FIGS. 16 and 17 depict another exemplary lid where in which like reference numerals indicate similar elements that have similar functionality. The example lid 200 can be arranged similar to the above examples, yet in this example, the cover gasket 236 and the biasing member for biasing the cover into the opened position can be formed as an integral or one-piece component. FIG. 16 shows the cover 210 in a closed position. And FIG. 17 shows the gasket in an opened position, but without the cover 210. In this example, the gasket 236 can include a gasket portion 236A and an arm portion 236B. The gasket portion 236A can be configured to form a seal between the cover 210 and the opening 206 of the pour spout 204. And the arm portion 236B can provide a spring force against the cover 210 such that the cover 210 is constantly biased into the opened position. In this way, when the user opens the cover 210 it will stay in the opened position and will not interfere with the user's ability to drink from the lid 200. The arm portion 236B can also include a pivot 236C, which is configured to rotate on the lid body 202. Also as shown in this example, the gasket 236 can include a circular portion 237, which includes an opening 237A for receiving a correspondingly shaped post 211 and flange portion 211A on the cover 210 to hold the gasket 236 into place on the cover 210. In this example, the gasket 236 can be formed of a silicone, TPU, TPE, or EPDM rubber material, but it is contemplated that other elastomeric materials may also be used.

FIGS. 18, 19, 20, and 21 show another example locking slider and release mechanism, which is similar to the locking slider and release mechanism discussed above where like reference numerals indicate similar elements and functionality. But in relation to the locking slider 316, in this example, two pairs of arms or projections can be provided. A second set of arms or projections 359 can be provided in this example for interfering with the first and second locking projections 118 on the lid body 102 in addition to the arms 358. So instead of the arms 358 acting as both a retention feature for keeping the locking slider on the release mechanism and for locking the release mechanism to prevent the release mechanism from inadvertently opening, the arms 358 only act as a retention feature by being biased away from each other and thus maintaining the locking slider 316 on the release mechanism 312. Also the set of projections 359 interfere with the first and second locking projections in order to keep the release mechanism from inadvertently opening. And in this example, a series of gripping ribs 356 can be provided. Also in relation to the release mechanism 312, the recessed front face 348 can be provided with an opening near the bottom to form an upside down U-shape. And the opening 342 can be formed straight along the top portion to simplify the manufacturing of the release mechanism 312.

A container lid may include lid body having a handle, a pour spout having an opening, and a first locking projection. The container lid may also include a flip cover having a flip cover flange and a cover gasket configured to plug the opening of the pour spout. A release mechanism can be included on the container lid and may have a pivot and a latching mechanism for receiving the flange of the flip cover to secure the flip cover in the closed position, and the release mechanism may include an opening. The container lid may also include a locking slider having a first arm configured to be received in the opening of the release mechanism. And the arm may include a distal end that is configured to interfere with the locking projection of the lid body to prevent the release mechanism from rotating and releasing the flip cover.

The first arm can move vertically along the release mechanism within the opening located in the release mechanism. And to open the flip cover, the locking slider can be displaced downwardly such that the distal end of the arm moves away from the locking projection of the lid body and the release mechanism is permitted to pivot to move the latching mechanism away from the flip cover flange and the flip cover can be moved into an open position. The cover lid may be biased toward the opened position by an elastic band. Also a first biasing member may bias the release mechanism into a latching position and wherein a second biasing member biases the locking slider into a locked position. The locking slider can include an upper pocket and the release mechanism may include a lower pocket for receiving the second spring. In one example, the lower pocket and upper pocket are both U-shaped.

The container lid may also include a third biasing member oriented in the same direction as the first biasing member and also biasing the release mechanism into a latched position. And the first biasing member and the third biasing member can be positioned between the release mechanism and the lid body. The release mechanism can include a first pair of spaced apart openings for receiving the first biasing member and the third biasing member. The lid body can include a second pair of spaced apart openings for receiving the first biasing member and the second biasing member.

In another example, the locking slider may include a second arm and the lid body may further include a second locking projection and the second arm may be configured to interfere with the second locking projection located on the lid body in order to prevent the release mechanism from rotating into a release position.

In another example, the first arm and the second arm of the locking slider can each have a tapered end. And the first arm and the second arm can be elastic and biased away from each other so that the first arm and the second arm interact with walls of the release mechanism to maintain the locking slider on the release mechanism. The cover gasket can include a biasing portion for biasing the cover into an opened position.

Also the pivot of the release mechanism may include a pair of posts that pivot within a pair of post openings in the lid body. The release mechanism may include a locking slider recess. And the locking slider can fit into the slider locking recess, and the locking slider may include a primary pushing surface for pressing the release mechanism inwardly to release the flip cover.

In another example, a lid can include a lid body having a drinking spout and locking projection, a flip cover having a flip cover flange, a release mechanism comprising a pivot and a latching mechanism for receiving the flange of the flip cover to secure the flip cover in the closed position, the release mechanism further comprising a slot, and a locking slider having an arm configured to be received within the slot of the release mechanism. The arm can have a distal end that is configured to interfere with the locking projection of the lid body to prevent the release mechanism from rotating and releasing the flip cover. To open the flip cover, the locking slider can be displaced downwardly such that the distal end of the arm moves away from the locking projection of the lid body and the release mechanism is permitted to pivot to move the latching mechanism away from the flip cover flange and the flip cover can be moved into an open position uncovering the drinking spout.

In another example, the locking slider may define an upper pocket and the release mechanism can include a lower pocket for receiving the second spring. The locking slider may include a second arm and the lid body may include a second locking projection. The second arm can be configured to interfere with the second locking projection located on the lid body in order to prevent the release mechanism from rotating into a release position. The release mechanism may include a locking slider recess. The locking slider may fit into the slider locking recess and the locking slider forms a primary pushing surface for pressing the release mechanism inwardly to release the flip cover.

In another example, a lid can include a lid body having an opening and locking projection and a flip cover having a flip cover flange where the flip cover can be configured to cover the opening. A release mechanism comprising a pivot and a latching mechanism for receiving the flange of the flip cover to secure the flip cover in the closed position, the release mechanism further comprising a slot, and a locking slider comprising an arm configured to be received within the slot of the release mechanism. The arm may include a distal end that is configured to interfere with the locking projection of the lid body to prevent the release mechanism from rotating and releasing the flip cover. The locking slider may define an upper pocket and the release mechanism may include a lower pocket for receiving a biasing member configured to bias the locking slider upwards along the latching mechanism. To open the flip cover, the locking slider can be displaced downwardly such that the distal end of the arm moves away from the locking projection of the lid body and the release mechanism is permitted to pivot to move the latching mechanism away from the flip cover flange and the flip cover can be moved into an open position uncovering the drinking spout.

In another example, the locking slider may include a second arm and the lid body further can include a second locking projection and the second arm can be configured to interfere with the second locking projection located on the lid body in order to prevent the release mechanism from rotating into a release position. The release mechanism may include a locking slider recess and wherein the locking slider fits into the locking slider recess and the locking slider forms a primary pushing surface for pressing the release mechanism inwardly to release the flip cover.

The present disclosure is disclosed above and in the accompanying drawings with reference to a variety of examples. The purpose served by the disclosure, however, is to provide examples of the various features and concepts related to the disclosure, not to limit the scope of the disclosure. One skilled in the relevant art will recognize that numerous variations and modifications may be made to the examples described above without departing from the scope of the present disclosure.

What is claimed is:

1. A container lid comprising:

a lid body comprising a pour spout having an opening, and a first locking projection;

a flip cover comprising a flip cover flange;

a release mechanism comprising a latching mechanism for receiving the flip cover flange of the flip cover to secure the flip cover in a closed position, the release mechanism comprising an opening;

a locking slider comprising a first arm configured to be received in the opening of the release mechanism, and wherein the first arm has a distal end that is configured to interfere with the first locking projection of the lid body to prevent the release mechanism from rotating and releasing the flip cover, wherein a first biasing member biases the release mechanism into a latching position and wherein a second biasing member biases the locking slider into a locked position.

2. The container lid of claim 1, wherein the first arm moves vertically along the release mechanism within the opening located in the release mechanism.

3. The container lid of claim 2, wherein to open the flip cover, the locking slider is displaced downwardly such that the distal end of the first arm moves away from the first locking projection of the lid body and the release mechanism is permitted to pivot to move the latching mechanism away from the flip cover flange and the flip cover can be moved into an open position.

4. The container lid of claim 1, wherein the flip cover is biased toward an opened position by an elastic band.

5. The container lid of claim 1, wherein the locking slider defines an upper pocket and the release mechanism comprises a lower pocket for receiving the second biasing member.

6. The container lid of claim 5, wherein the lower pocket and the upper pocket are both U-shaped.

7. The container lid of claim 1, further comprising a third biasing member oriented in a same direction as the first biasing member and also biasing the release mechanism into a latched position, wherein the first biasing member and the third biasing member are positioned between the release mechanism and the lid body and wherein the release mechanism further comprises a first pair of spaced apart openings for receiving the first biasing member and the third biasing member and wherein the lid body comprises a second pair of spaced apart openings for receiving the first biasing member and the second biasing member.

8. A container lid comprising: a lid body comprising a pour spout having an opening, and a first locking projection, a flip cover comprising a flip cover flange; a release mechanism comprising a latching mechanism for receiving the flip cover flange of the flip cover to secure the flip cover in a closed position, the release mechanism comprising an opening; a locking slider comprising a first arm configured to be received in the opening of the release mechanism, and wherein the first arm has a distal end that is configured to interfere with the first locking projection of the lid body to prevent the release mechanism from rotating and releasing the flip cover; wherein the locking slider comprises a second arm and the lid body further comprises a second locking projection and the second arm is configured to interfere with the second locking projection located on the lid body in order to prevent the release mechanism from rotating into a release position; wherein the first arm and the second arm of the locking slider each have a tapered end and wherein the first arm and the second arm are elastic and biased away from each other so that the first arm and the second arm interact with walls of the release mechanism to maintain the locking slider on the release mechanism.

9. The container lid of claim 8 wherein the first arm and the second arm comprise a first pair of arms and the container lid comprises a second pair of arms and wherein the second pair of arms are both elastic and biased away from each other so that the second pair of arms interact with walls of the release mechanism to maintain the locking slider on the release mechanism.

10. The container lid of claim 1, wherein the flip cover comprises a cover gasket for sealing the pour spout and wherein the flip cover comprises a biasing portion for biasing the flip cover into an opened position.

11. The container lid of claim 1, wherein the pivot of the release mechanism comprises a pair of posts that pivot within a pair of post openings in the lid body.

12. The container lid of claim 1, wherein the release mechanism comprises a locking slider recess and wherein the locking slider fits into the locking slider recess and the locking slider forms a primary pushing surface for pressing the release mechanism inwardly to release the flip cover.

13. A lid comprising:

a lid body comprising an opening and locking projection;

a flip cover comprising a flip cover flange and a pair of separate pivot boss features, the flip cover being configured to cover the opening in a first position and to uncover the opening in a second position through the pair of pivot boss features allowing the flip cover to rotate on the lid body;

a release mechanism comprising a pivot and a latching mechanism for receiving the flip cover flange of the flip cover to secure the flip cover in a closed position, the release mechanism further comprising a slot; and a locking slider comprising an arm configured to be received within the slot of the release mechanism, and wherein the arm has a distal end that is configured to interfere with the locking projection of the lid body to prevent the release mechanism from rotating and releasing the flip cover;

wherein to open the flip cover, the locking slider is displaced downwardly such that the distal end of the arm moves away from the locking projection of the lid body and the release mechanism is permitted to pivot to move the latching mechanism away from the flip cover flange and the flip cover can be moved into an open position uncovering the opening of the lid body;

wherein the locking slider defines an upper pocket and the release mechanism comprises a lower pocket for receiving a biasing member wherein the biasing member biases the locking slider into a locked position.

14. The lid of claim 13, wherein the locking slider comprises a second arm and the lid body further comprises a second locking projection and the second arm is configured to interfere with the second locking projection located on the lid body in order to prevent the release mechanism from rotating into a release position.

15. The lid of claim 13, wherein the release mechanism comprises a locking slider recess and wherein the locking slider fits into the locking slider recess and the locking slider forms a primary pushing surface for pressing the release mechanism inwardly to release the flip cover.

16. A lid comprising:

a lid body comprising a drinking spout and locking projection;

a flip cover having a flip cover flange;

a release mechanism comprising a pivot and a latching mechanism for receiving the flip cover flange of the flip cover to secure the flip cover in a closed position, the release mechanism further comprising a slot; and a locking slider comprising an arm configured to be received within the slot of the release mechanism, and wherein the arm has a distal end that is configured to interfere with the locking projection of the lid body to prevent the release mechanism from rotating and releasing the flip cover; the locking slider defines an upper pocket and the release mechanism comprises a lower pocket for receiving a biasing member configured to bias the locking slider upwards along the latching mechanism into a locked position;

wherein to open the flip cover, the locking slider is displaced downwardly such that the distal end of the arm moves away from the locking projection of the lid body and the release mechanism is permitted to pivot to move the latching mechanism away from the flip cover flange and the flip cover can be moved into an open position uncovering the drinking spout.

17. The lid of claim 16, wherein the locking slider comprises a second arm and the lid body further comprises a second locking projection and the second arm is configured to interfere with the second locking projection located on the lid body in order to prevent the release mechanism from rotating into a release position.

18. The lid of claim 16, wherein the release mechanism comprises a locking slider recess and wherein the locking slider fits into the locking slider recess and the locking slider forms a primary pushing surface for pressing the release mechanism inwardly to release the flip cover.

* * * * *